US008346124B2

(12) United States Patent
Igarashi et al.

(10) Patent No.: US 8,346,124 B2
(45) Date of Patent: Jan. 1, 2013

(54) IMAGE-FORMING DEVICE AND PROCESS CARTRIDGE CONFIGURED TO BE INSTALLED IN AND REMOVED THEREFROM

(75) Inventors: Hiroshi Igarashi, Nagoya (JP); Yasushi Okabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/239,788

(22) Filed: Sep. 22, 2011

(65) Prior Publication Data

US 2012/0008977 A1 Jan. 12, 2012

Related U.S. Application Data

(63) Continuation of application No. 13/020,603, filed on Feb. 3, 2011, now Pat. No. 8,050,592, which is a continuation of application No. 11/523,628, filed on Sep. 20, 2006, now Pat. No. 7,907,868.

(30) Foreign Application Priority Data

Sep. 27, 2005 (JP) ..... 2005-280199
Dec. 27, 2005 (JP) ..... 2005-374659

(51) Int. Cl.
*G03G 15/00* (2006.01)

(52) U.S. Cl. ..... 399/110; 399/111

(58) Field of Classification Search ..... 399/110, 399/111, 113, 299, 303, 112
See application file for complete search history.

(56) References Cited

U.S. PATENT DOCUMENTS

| | | | | |
|---|---|---|---|---|
| 5,410,387 | A | 4/1995 | Yamada | |
| 5,493,366 | A | 2/1996 | Satoh et al. | |
| 5,663,787 | A | 9/1997 | Haneda et al. | |
| 5,752,133 | A | 5/1998 | Nagase et al. | |
| 6,708,011 | B2 | 3/2004 | Nomura et al. | |
| 6,721,521 | B2 * | 4/2004 | Kataoka et al. | 399/112 |
| 7,177,575 | B2 | 2/2007 | Okabe | |
| 2003/0053819 | A1 | 3/2003 | Nomura et al. | |
| 2004/0165910 | A1 | 8/2004 | Sato et al. | |

(Continued)

FOREIGN PATENT DOCUMENTS

JP 6-250512 9/1994

(Continued)

OTHER PUBLICATIONS

JP Office Action dtd Jul. 20, 2010, JP Appln. 2005-374659, English translation.

(Continued)

*Primary Examiner* — David Gray
*Assistant Examiner* — Laura K Roth
(74) *Attorney, Agent, or Firm* — Banner & Witcoff, Ltd.

(57) ABSTRACT

An image forming device includes a casing having a guide and a drawer configured to be movable between an inner position in which the drawer is located at an inner side of the casing and an outer position in which the drawer is located at an outer side of the casing. The drawer may include a plurality of photosensitive drums and a support disposed closer to a rear edge of the drawer than a front edge of the drawer. The guide may include a main guiding surface and one or more inclined surfaces. An engagement of the support with the one or more inclined surfaces of the guide regulates movement of the drawer upward or downward during movement of the drawer between the inner position and the outer position.

8 Claims, 19 Drawing Sheets

U.S. PATENT DOCUMENTS

| | | | | |
|---|---|---|---|---|
| 2005/0069347 | A1 | 3/2005 | Okabe | |
| 2005/0127803 | A1 | 6/2005 | Chen | |
| 2006/0067734 | A1 | 3/2006 | Igarashi et al. | |
| 2006/0140669 | A1* | 6/2006 | Sato | 399/111 |
| 2006/0228131 | A1* | 10/2006 | Kimura et al. | 399/111 |
| 2007/0140710 | A1 | 6/2007 | Okano | |

FOREIGN PATENT DOCUMENTS

| | | | |
|---|---|---|---|
| JP | 7-092884 | | 4/1995 |
| JP | 7-248715 | | 9/1995 |
| JP | 9-160471 | A | 6/1997 |
| JP | 9-304994 | A | 11/1997 |
| JP | 10-161421 | A | 6/1998 |
| JP | 11-174940 | A | 7/1999 |
| JP | 11-219044 | | 8/1999 |
| JP | 2000-082881 | A | 3/2000 |
| JP | 2000-321956 | A | 11/2000 |
| JP | 2002-268320 | A | 9/2002 |
| JP | 2002-304030 | A | 10/2002 |
| JP | 2003-015378 | A | 1/2003 |
| JP | 2003-076106 | A | 3/2003 |
| JP | 2003-107837 | | 4/2003 |
| JP | 2003-107838 | | 4/2003 |
| JP | 2004-109886 | A | 4/2004 |
| JP | 2004-258138 | A | 9/2004 |
| JP | 2005-107189 | A | 4/2005 |

OTHER PUBLICATIONS

JP Office Action dtd Nov. 17, 2010, JP Appln. 2005-374659, English translation.

* cited by examiner

IMAGE-FORMING DEVICE AND PROCESS CARTRIDGE CONFIGURED TO BE INSTALLED IN AND REMOVED THEREFROM

CROSS REFERENCE TO RELATED APPLICATIONS

The present application is a continuation of co-pending U.S. patent application Ser. No. 13/020,603, filed Feb. 3, 2011, which is a continuation of U.S. patent application Ser. No. 11/523,628, filed Sep. 20, 2006, now U.S. Pat. No. 7,907, 868, issued Mar. 15, 2011, which claims priority from Japanese Patent Application Nos. 2005-280199 filed Sep. 27, 2005 and 2005-374659 filed Dec. 27, 2005, the entire contents of which are incorporated herein by reference.

FIELD

Aspects of the invention relate to image-forming devices and process cartridges.

BACKGROUND

Tandem style color laser printers are known for their use as image-forming devices in electrophotography. For example, the laser printer described in Japanese Patent Application Publication No. 2003-107838 is equipped with several image-forming portions including a photosensitive drum, developing device, charger, etc. that are housed inside the main unit casing. Each of the image-forming portions is housed in a drawer and is configured so that the drawer can be drawn out from the main unit casing and the developing device can be replaced.

Such an image-forming device often have guiding walls that extend from the front to the back inside the main unit casing and which are used to guide the insertion and removal of the drawer. Additionally, when the drawer has been removed, support portions that are positioned at the rear of the drawer come into contact with the downward-facing surfaces of the guiding walls so that the guiding walls bear the upward load from each support portion and vertical inclination of the drawer is limited.

However, when parts in the drawer are heavy, the load on the support portions increases when the drawer is pulled out making it more difficult to insert or remove the drawer. As a countermeasure, it is conceivable that locating the support portions closer to the rear would reduce the load on the support portions. However, when the drawer is extended rearward to locate the support portions farther back, the device increases in size.

SUMMARY

Aspects of the present invention are directed to an image forming device including a casing having a guide, image forming portions configured to form images on a recording medium, and a drawer configured to be installed in and withdrawn from the casing along the guide in a first direction for installation and in a second direction for withdrawal opposite the first direction. The drawer may include a housing configured to house each image forming portion, a projecting portion coupled to the housing, the projecting portion protruding from the housing in the first direction, and a first support portion coupled to the projecting portion, wherein an engagement of the first support portion with the guide regulates movement of the drawer upward or downward during installation and withdrawal.

According to another aspect of the invention, a process cartridge is configured to be installed in and withdrawn from a casing of an image forming device along a guide in a first direction for installation and a second direction opposite the first direction for withdrawal. The process cartridge may include image forming portions configured to form images on a recording medium, a housing configured to house each image forming portion, wherein the image forming portions are configured to be removable from the housing, a projecting portion coupled to the housing, the projecting portion protruding from the housing in the first direction, and a first support portion coupled to the projecting portion, wherein an engagement of the first support portion with the guide regulates movement of the drawer upward or downward during installation and withdrawal.

DETAILED DESCRIPTION

Overall Configuration of Laser Printer

Figure 1:
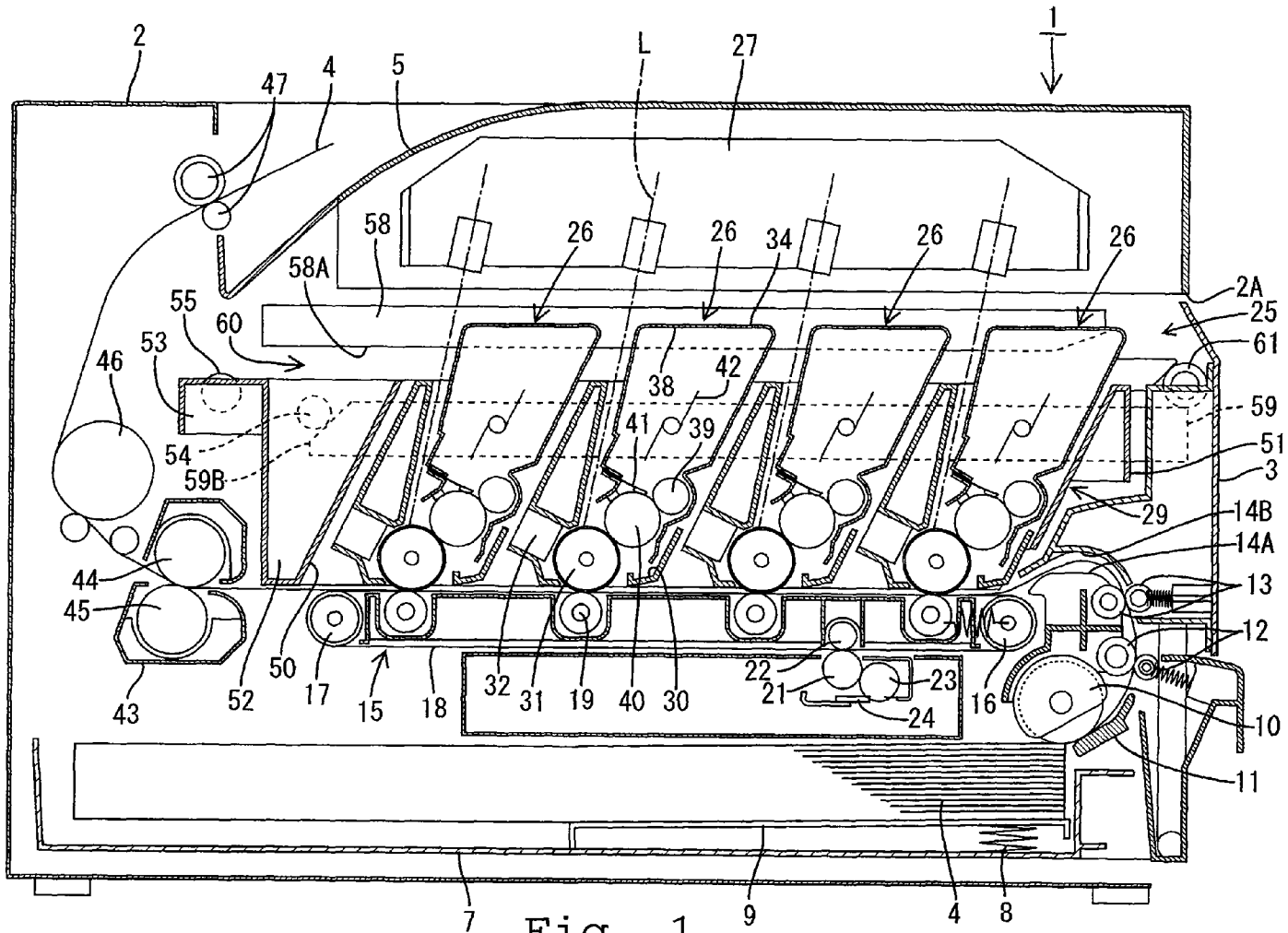
FIG. 1 is a lateral cross-section showing a schematic configuration of the laser printer according to aspects of the invention.

FIG. 1 is a lateral cross-section showing a schematic configuration of the laser printer 1 as an image-forming device. Note also that in the description below, the right side corresponds to the front in each figure.

The laser printer 1 is a tandem-style color laser printer equipped with the main unit casing 2. The front surface (one side) of the main unit casing 2 has an opening 2A and the front cover 3, which can open and close, covers the opening 2A. Leaving the front cover 3 open makes it possible install or remove the drawer 25 or the belt unit 15 in the main unit casing 2 and eliminate jams that occur. Additionally, a paper-receiving tray 5, which is where the paper 4 that is used as a recording medium will be output after image formation, is formed on the upper surface of the main unit casing 2.

Underneath the main unit casing 2, the paper feed tray 7, in which the image-forming paper 4 rests, is installed so that it can be pulled forward. In the paper feed tray 7, is a paper pressure plate 9, which can move at an angle so that tension from the spring 8 will push the front edge of the paper 4 upwards. Also, above the front edge of the paper feed tray 7 is a pick-up roller 10 and a separation pad 11, which presses against the pick-up roller 10 under tension from a spring (not shown). Furthermore, above the pick-up roller 10 and at an angle, is a pair of paper feed rollers 12, above which are a pair of resist rollers 13 and a pair of guides 14A and 14B.

The paper 4 that is uppermost in the paper feed tray 7 is pushed by the paper pressure plate 9 toward the pick-up roller 10 and, when held between the pick-up roller 10 and the separating pad 11, will be separated into individual sheets by the rotation of the pick-up roller 10. Then, the paper 4 that is fed in from between the pick-up roller 10 and the separating pad 11 is fed into the resist roller 13 by the paper feed roller 12. At the resist roller 13, the paper 4 undergoes alignment correction and then is fed to the downstream side at a specific interval, where the guides 14A and 14B guide the paper 4 onto the conveyor belt 18 in the belt unit 15.

The belt unit 15, which can be inserted into or removed from the main unit casing 2, is equipped with a conveyor belt 18 that is suspended horizontally between the pair of belt support rollers 16 and 17. The conveyor belt 18 is circular belt made from polycarbonate or other resin. Rear belt support roller 17 is driven by a motor and moves cyclically in a counterclockwise direction in FIG. 1, transporting the paper 4 that rests on its upper surface. The inner surface of the conveyor belt 18 has four transfer rollers 19 arranged front-to-back, in a line, at specific intervals and opposing the photosensitive drums 31 in the image-forming portion 26, which will be described below, and the conveyor belt 18 is held between the each of the photosensitive drums 31 and their corresponding transfer rollers 19. During printing, a bias is applied between the transfer rollers 19 and the photosensitive drums 31.

Underneath the belt unit 15 is the cleaning roller 21, which removes toner or paper dust that adheres to the conveyor belt 18. The cleaning roller 21 includes a metal axle with a foamed silicon material around it and it faces the metal back-up roller 22 in the belt unit 15 with the conveyor belt 18 in between. A specific bias is applied between the cleaning roller 21 and the back-up roller 22 that causes the toner and other debris on the conveyor belt 18 to be drawn electrically to the cleaning roller 21. Additionally, the metal recovery roller 23 is in contact with the cleaning roller 21, which removes the toner and other debris adhering to the surface. Also, there is a blade 24 that is in contact with that recovery roller 23 to scrape off toner or debris adhering to the surface.

There is a scanner module 27 in the upper part of the interior of the main unit casing 2 and there is a drawer 25 beneath (interior of the opening 2A) that. The belt unit 15 described above is located on the bottom of the drawer 25.

Using a high-speed scan, the scanner module 27 fires the laser light L for each color onto the surface the corresponding photosensitive drum 31 based on the specified image data.

The drawer 25 is equipped with four image-forming portions 26 that correspond to each of the following colors: magenta, yellow, cyan and black. These image-forming portions 26 are arranged in a line that goes front to back. Each of the image-forming portions 26 is configured and equipped with a photosensitive drum 31 as an image carrier, a scorotron charger 32 and an image-developing cartridge 34 as a developing device. Additionally, the drawer 25 is equipped with a housing 50, which has four cartridge receiving portions 30 that are lined up front to back. Each of the cartridge receiving portions 30 is inclined vertically. The developing cartridges 34 can be attached to or removed from the cartridge receiving portions 30. Also, the photosensitive drum 31 of each of the image-forming portions 26 as well as the scorotron charger 32, which is next to the photosensitive drum 31 are held inside the housing 50 on the bottom edge of each of the cartridge receiving portions 30. Note also that, as explained below, the drawer 25 is installed so that it can be withdrawn freely as well as inserted or removed from the main unit casing 2.

The photosensitive drum 31 includes a grounded, metal drum main unit that is covered with a surface layer of polycarbonate or other photosensitive layer that has a positive static charge.

The scorotron charger 32 is placed so that it is behind the photosensitive drum 31, inclined upward, separated by a specific distance so that there is no contact with the photosensitive drum 31 and facing the photosensitive drum 31. The scorotron charger 32 generates a corona discharge from a wire made of, for example, tungsten (not shown) and imparts a uniform, positive charge to the surface of the photosensitive drum 31.

The developing cartridge 34 has an upper interior portion that contains a toner chamber 38 and a supply roller 39, the developing roller 40 and a layer thickness-regulating blade 41. Each toner chamber 38 contains a nonmagnetic, single component toner, which carries a positive charge, in yellow, magenta, cyan or black as developing agents, respectively. Also, each of the toner chambers 38 has an agitator 42 to stir the toner.

The supply roller 39 includes a metal axle covered with an electrically conductive foam material. The developing roller 40 includes a metal axle covered with an electrically conductive rubber material. The toner released from the toner-housing chamber 38 is fed to the developing roller 40 by the rotation of the supply roller 39. Friction between the supply roller 39 and the developing roller 40 provides the toner with a positive charge. Then, the rotation of the developing roller 40 feeds the toner to a space between the layer thickness-regulating blade 41 and the developing roller 40, where friction provides the toner with an additional charge. The regulating blade 41 removes excess toner from the developing roller 40 and leaves a thin layer of uniform thickness of toner on the developing roller 40.

When the photosensitive drum 31 rotates, the scorotron charger 32 applies a uniform positive charge to the surface of the drum 31. Subsequently, the drum 31 is exposed to light transmitted by the high-speed laser scanner from the scanner module 27 forming the electrostatic latent image corresponding to the image to be formed on the paper 4.

Next, the rotation of the developing roller 40 causes the positively charged toner to be applied to the surface of the photosensitive drum 31 having the electrostatic latent image formed thereon. In this way, an image is formed where the toner adheres to the exposed portions of the surface of the photosensitive drum 31.

Subsequently, the toner images carried on the surfaces of each of the photosensitive drums 31 are transferred sequentially to the paper 4 by the negatively charged bias applied to the transfer rollers 19 when the paper 4, transported by the conveyor belt 18, passes through each of the transfer positions between the photosensitive drums 31 and the transfer rollers 19. In this way, the paper 4, with the transferred toner images, is transported to the fixing unit 43.

The fixing unit 43 is placed toward the rear of the conveyor belt 18 inside the main unit casing 2. The fixing unit 43 is equipped with a halogen lamp or other heat source, as well as a heating roller 44 and, beneath the heating roller 44, a pressure roller 45 that opposes the heating roller 44 and is pressed against and turned by the heating roller 44. In the fixing unit 43, the paper 4, which carries a four-color toner image, is held, transported and heated by the heating roller 44 and the pressure roller 45, which causes the toner image to become fixed to the paper 4. The heat-fixed paper 4 is transported to the discharge roller 47, placed at the top of the main unit casing 2 by the transport roller 46 that is placed at the upper rear of the fixing unit 43, and ejected into the aforementioned paper-receiving tray 5 by the discharge roller 47.

Drawer Support Structure

Figure 2:
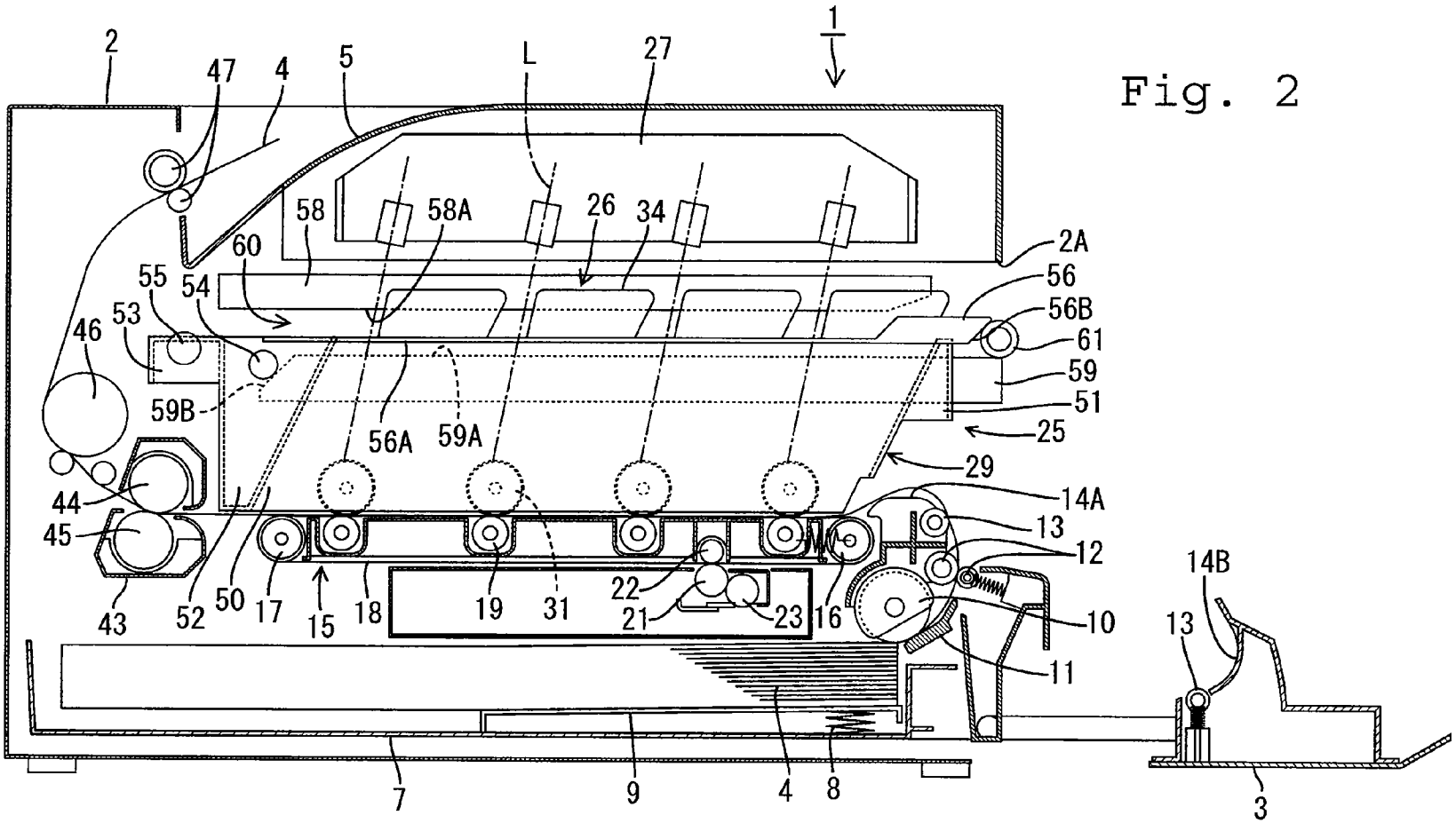
FIG. 2 is a lateral cross-section diagram showing the front surface cover open.
Figure 3:
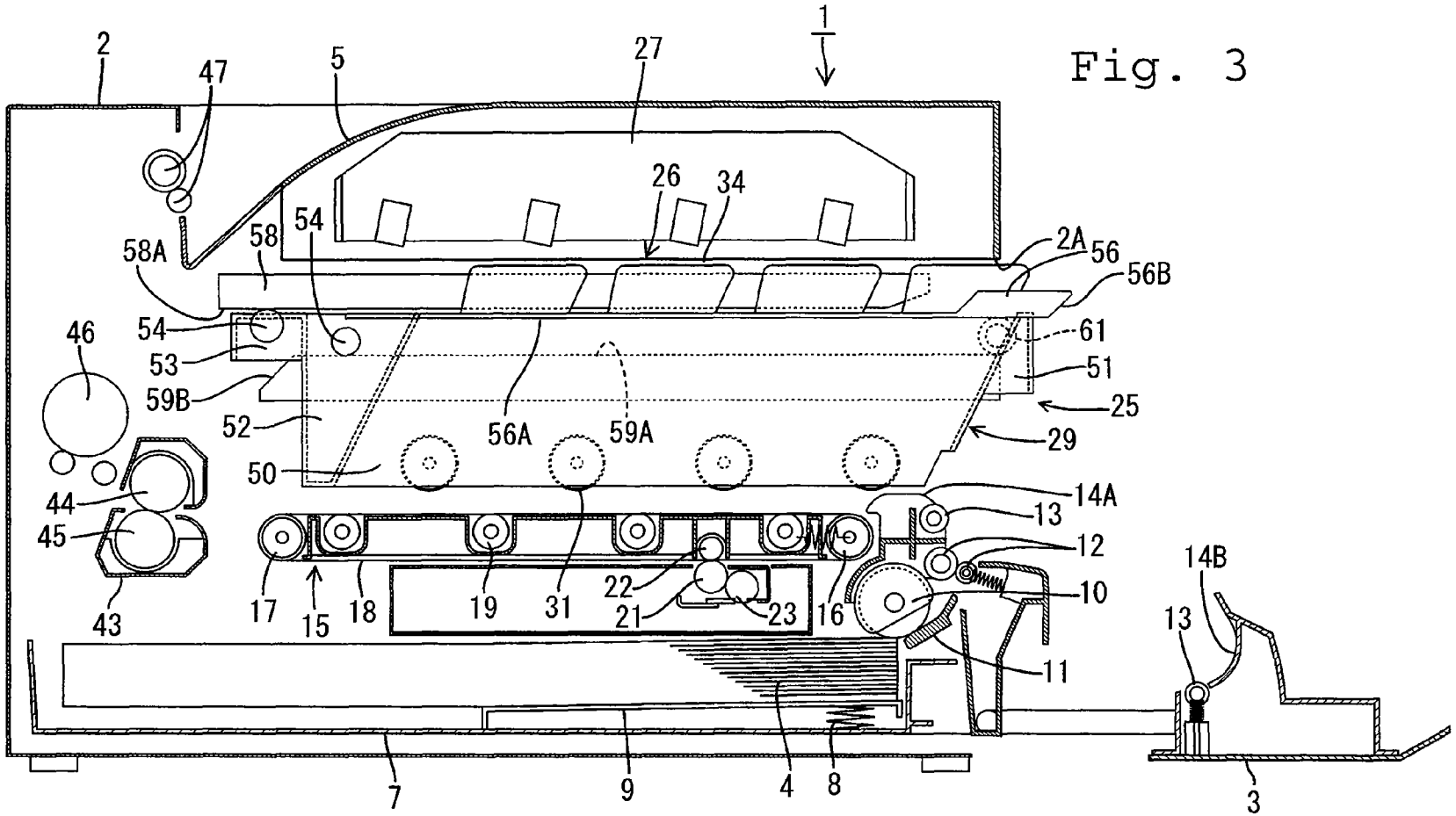
FIG. 3 is a lateral cross-section showing the drawer in a partly withdrawn state.
Figure 4:
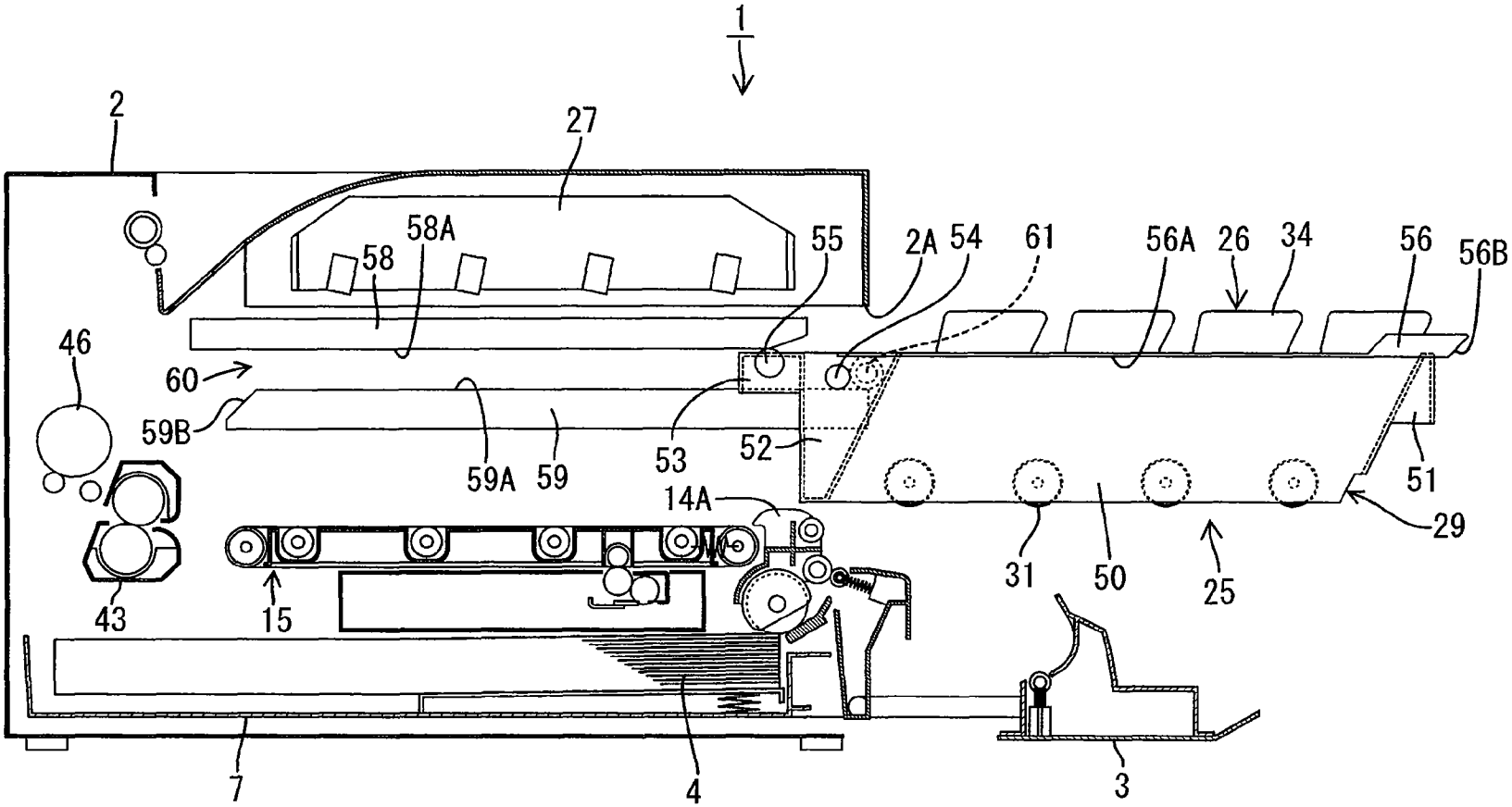
FIG. 4 is a lateral cross-section diagram showing the withdrawal motion of the drawer.
Figure 5:
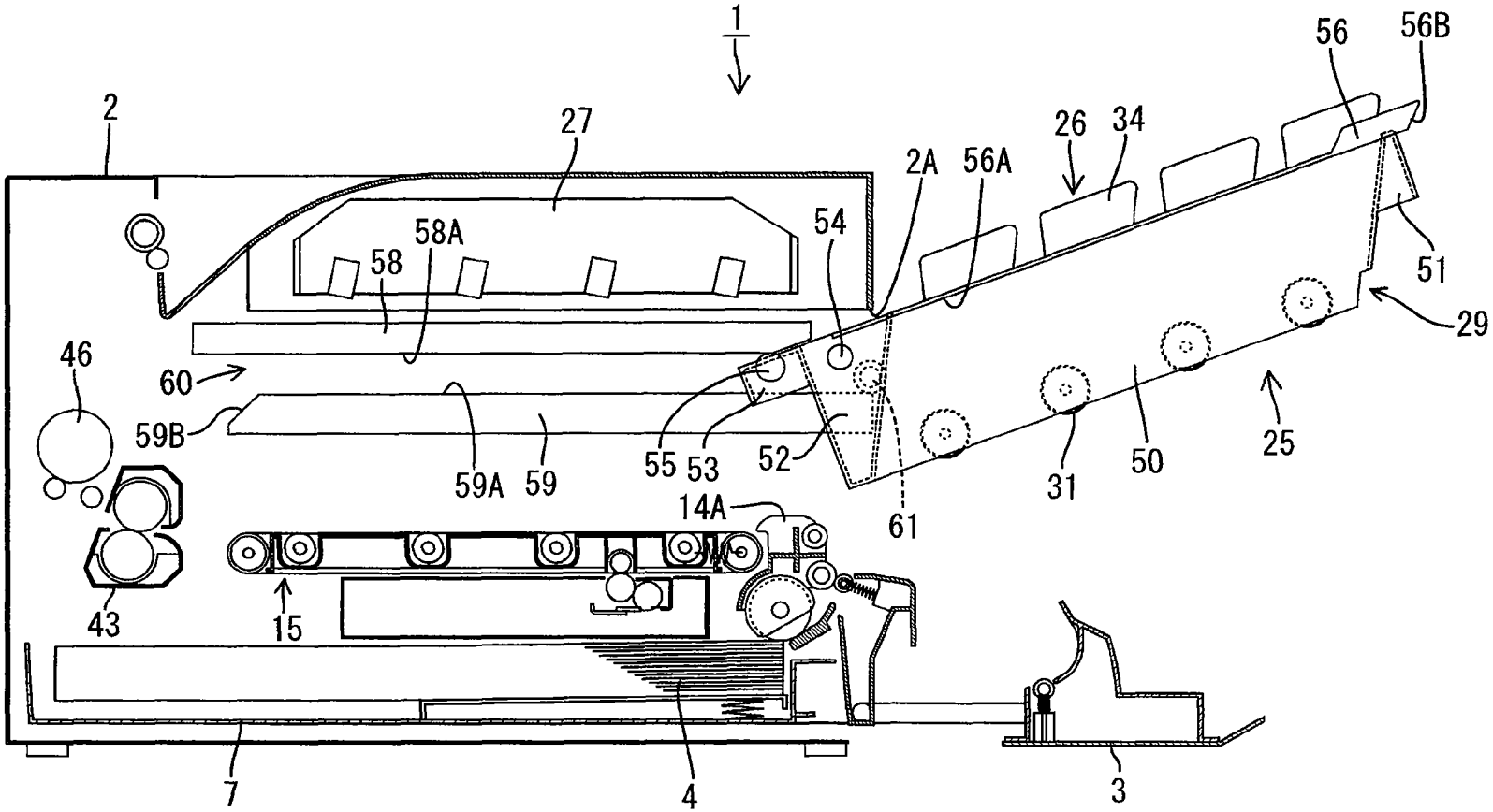
FIG. 5 is a lateral cross-section showing the drawer partly removed.

FIG. 2 is a lateral cross-section diagram showing the front cover 3 open. FIG. 3 is a lateral cross-section diagram showing the drawer 25 partly withdrawn. FIG. 4 is a lateral cross-section diagram showing the restriction of the withdrawal movement of the drawer 25. FIG. 5 is a lateral cross-section diagram showing the drawer 25 partly removed.

The drawer 25 is equipped with a housing 50 that houses the four image-forming portions 26 described above and a handle 51 formed on the upper part of the front of the housing 50. Also, on the back portion of the housing 50, is an extending portion 52, which has the same height and width dimensions as the housing 50 and projects rearward. Note also that the back of the housing 50 projects further rearward towards the bottom. The front of the extending portion 52 vertically overlaps the section of the housing 50 that projects rearward. Additionally, the rear edge of the extending portion 52 is a perpendicular surface (in other words, the surface is at a right angle to the withdrawal direction of the drawer 25). A projecting portion 53, which projects partly rearward at the top of the rear edge, is formed across the entire width. The fixing unit 43 described above is located in a position that is below (in other words at right angles to the direction of withdrawal) the projecting portion 53 and also behind the extending portion 52 when the drawer 25 is installed inside the casing 2.

The first support 54, which is made from a freely rotating body, is attached to both the right and left lateral surfaces of the extending portion 52 at the top. Additionally, the second support 55, which is made from a freely rotating body, is attached to both the left and right lateral surfaces of the projecting portion 53. The second support 55 is slightly larger than the outside diameter of the first support 54. The second support 55 is attached farther back and slightly higher than the first support 54. Also, the support wall 56 projects horizontally toward the outside front to back (in the withdrawal direction), and is formed farther forward than the first support 54 on the upper edge of the housing 50 on both lateral surfaces. The support wall 56 is equipped with the downward-facing horizontal surface 56A, which extends front to back, and the downward-facing guiding surface 56B, which is inclined upward toward the front and joins the front edge.

On the other end, a vertical pair of guiding walls 58 and 59 is located inside the main unit casing 2 on the right and left sides of the drawer 25. Each of the guiding walls 58 and 59 extends along the longitudinal direction (horizontal direction) and has approximately the same lengthwise dimensions as the drawer 25. Additionally, the upper guiding wall 58 has a downward-facing guiding surface 58A and the lower guiding wall 59 has an upward-facing surface 59A. The guiding surfaces 58A and 59A are positioned so that they are parallel to and face each other at a specific distance. Also, the pair of supports 54 and 55 in the drawer 25 is able to enter the groove 60 that is formed between the two guiding walls 58 and 59 (the two guiding surfaces 58A and 59A). When the first support 54 comes into contact with the lower guiding surface 59A and the second support 55 comes into contact with the upper guiding surface 58A, the drawer 25 is supported by the guiding walls 58 and 59. Furthermore, the upward-facing guiding surface 59B, which inclines upward at the front edge, is formed at the rear edge of the lower guiding wall 59, joining the rear edge of the guiding surface 59A.

Additionally, the support wall 56 of the drawer 25 is placed inside the groove 60 between the two guiding walls 58 and 59 so that it does not come into contact with the vertical guiding surfaces 58A and 59A. Additionally, the stopper 61 is located at the front edge position of the lower guiding surface 59A (the front edge position of the groove 60). The stopper 61 can be a rotating body that rotates freely. In one aspect, the stopper 61 could be a rotating axle with an external covering of rubber or other elastic material. Note also that the outside diameter of the stopper 61 is greater than the outside diameter of the first support 54. The stopper 61 supports the drawer 25 by supporting the support wall 56 on its upper surface.

Operation of Illustrative Aspects

When the drawer 25 is installed in the main unit casing 2, the guiding surface 56B of the support wall 56 will rest on the upper surface of the stopper 61 and the first support 54 will rest on top of the guiding surface 59B of the guiding wall 59, so that the stopper 61 and the guiding wall 59 will support the drawer 25 in a horizontal position. At this point, each of the photosensitive drums 31 will be in contact with the conveyor belt 18, as shown in FIGS. 1 and 2.

When the drawer 25 is withdrawn from the main unit casing 2, first the front cover 3 is opened, as shown in FIG. 2, and then the drawer 25 is withdrawn toward the front. At that point, with the withdrawing motion, the guiding of the guiding surfaces 56B and 59B will cause the front edge of the support wall 56 and the first support 54 to be raised up at nearly the same time and the drawer 25 will move forward and upward. Since each of the photosensitive drums 31 of the drawer 25 is separated from the conveyor belt 18, the photosensitive drums 31 will not rub against the conveyor belt 18, which makes it possible to pull the drawer 25 out smoothly.

As shown in FIG. 3, as the horizontal surface 56A of the support wall 56 rides up on the stopper 61, the first support 54 rides up on top of the guiding surface 59A of the lower guiding wall 59 and the second support 55 comes into contact with the guiding surface 58A of the upper guiding wall 58. In this state, the counterclockwise (as shown in the FIG. 3) rotation moment around the stopper 61 takes effect in the drawer 25 and the lower guiding wall 59 uses the rotation moment to support the downward load that is received from the first support 54. Also, in this state, the lower edge of the drawer 25 (the lower edge of the photosensitive drums 31) is supported in a position that is higher than the guide 14A, located near the lower edge of the opening 2A.

If the drawer 25 is withdrawn even farther from the position shown in FIG. 3, the two supports 54 and 55 will come into contact with their respective guiding walls 58 and 59, which will restrict the inclined movement of the drawer 25 and the drawer 25 will be guided forward, while maintaining a horizontal position. Next, when the center of gravity of the drawer 25 moves farther forward than the position of the stopper 61, the clockwise rotation moment around the stopper 61 will take effect and the rotation moment will cause the upper guiding wall 58 to bear the upward load from the second support 55 in the drawer 25.

Next, as shown in FIG. 4, when the drawer 25 is withdrawn to a position where nearly the entire housing 50 is exposed outside the opening 2A, the first support 54 comes into contact with the rear surface of the stopper 61 and both support 54 and stopper 61 engage and the withdrawal movement of the drawer 25 is restricted. Here, when the outside diameter of the first support 54 is greater than the outside diameter of stopper 61 (more accurately, when the center of the first support 54 is higher than the center of stopper 61), when both support 54 and stopper 61 come into contact with each other, the first support 54 rides up on the stopper 61 and there is a risk that the drawer 25 will come out of alignment. In contrast, according to this aspect because the outside diameter of the first support 54 is smaller than the outside diameter of the stopper 61 (the center of the first support 54 is lower than the center of the stopper 61) it is less likely that support 54 and stopper 61 will become disengaged. As such, the drawer 25 can be kept from coming out of alignment. In this way, it is possible to replace each of the developing cartridges 34 while the drawer 25 is pulled out.

When removing the drawer 25 from the main unit casing 2 from the state shown in FIG. 4, the handle 51 is grasped and the front edge of the drawer 25 is lifted up, which causes the rear edge of the drawer 25 to incline downward. This causes the second support 55 to come into contact with the lower guiding surface 59A and then for the first support 54 to rise up from the lower guiding surface 59A, releasing the engagement between the support 54 and the stopper 61 (see FIG. 5.). Here, the first support 54 and the stopper 61 can both rotate freely, so the engagement can be released easily. Note also that FIG. 5 shows the state after the drawer 25 has been inclined, so the rear of the drawer 25 is shown inclined slightly upward and the handle that is located in the back of the drawer 25 (not shown) is grasped. With the drawer in an inclined position, if the drawer 25 is pulled upward and at an angle, the drawer 25 will separate from the main unit casing 2. In this way, by removing the drawer 25 from the main unit casing 2, the belt unit 15 or the drawer 25 can be replaced (such as when the photosensitive drums 31 have become worn) or maintenance inside the main unit housing can be carried out, such as clearing jams.

Note also that when the drawer 25, which has been removed from the main unit casing 2, is going to be inserted back into the main unit casing 2, the above procedure would be reversed and the drawer 25 would be positioned so that the rear edge is inclined downward and, after inserting the two support portion 54 and 55 into the groove 60, the drawer 25 would be pushed inside in a horizontal position. When the first support 54 reaches the guiding surface 59B of the guiding wall 59, the stopper 61 reaches the guiding surface 56B of the support wall 56 and the drawer 25 moves downward at an angle while maintaining a position that is nearly horizontal, reaching an installed position and each of the photosensitive drums 31 will come into contact with the upper surface of the conveyor belt 18.

The aspects described above make it possible to easily remove the drawer 25 because the support portions 54 and 55, which restrict the vertically inclined movement of the drawer 25, are positioned farther back than the housing 50 and the load on the support portions 54 and 55 is reduced when the drawer 25 is removed. Additionally, because the first support 54 is positioned on the projecting portion 53, which projects behind the housing 50, other parts can be arranged in the space (the space that overlaps with the projecting portion 53) behind the housing 50, preventing an increase in the size of the device.

Also, behind the drawer 25 in the main unit casing 2, the fixing unit 43 is placed in a position that overlaps with the projecting portion 53, so space can be used efficiently.

Additionally, because both of the support portions 54 and 55 are made from rotating bodies, when the drawer 25 is pulled out or pushed in, the amount of friction generated between the support portions 54, 55 and the guiding walls 58 and 59 is reduced, which can allow for smooth operation.

When pulling out the drawer 25, the movement can be restricted by engaging the stopper 61 of the main unit casing 2, which acts as an interlocking module of the drawer 25, with the first support 54. When the drawer 25 does not have to be removed from the main unit casing 2, the engagement between the stopper 61 and the first support can prevent accidental removal of the drawer 25.

Also, the fact that the drawer 25 can be removed from the main unit casing 2 makes it very useful when performing maintenance inside the main unit casing 2.

Furthermore, configuration of the drawer 25 is simpler, because the first support 54 serves as the interlocking module that engages with the stopper 61.

Additionally, the drawer 25 is supported by placing the support wall 56 on the top of the stopper 61 that is located in the main unit casing 2. When a rotation moment is generated around the stopper 61 in the drawer 25, the support portions 54 and 55 come into contact with and are supported by the guiding walls 58 and 59, which restrict the inclined movement of the drawer 25.

Additionally, because the stopper 61 is made from a rotating body, when pulling out or inserting the drawer 25, the amount of friction generated between the stopper 61 and the support wall 56 is reduced, which can make the action of pulling out the drawer 25 easier.

Furthermore, because the stopper 61 also restricts the withdrawal movement of the drawer 25, the configuration of the main unit casing 2 can be simplified.

Also, there is no need to provide a separate groove to accommodate the support wall 56 inside the main unit casing 2 because the support wall 56 is located between the pair of guiding surfaces 58A and 59A, which are vertically opposed. This can improve the use of space and allow the device to be made more compact.

Additionally, the drawer 25 is separated from the conveyor belt 18 by the guiding surfaces 56B and 59B as it is pulled out. For this reason, the drawer 25 can be pulled out smoothly without any rubbing between the image-forming portions 26 and the conveyor belt 18.

Figure 6:
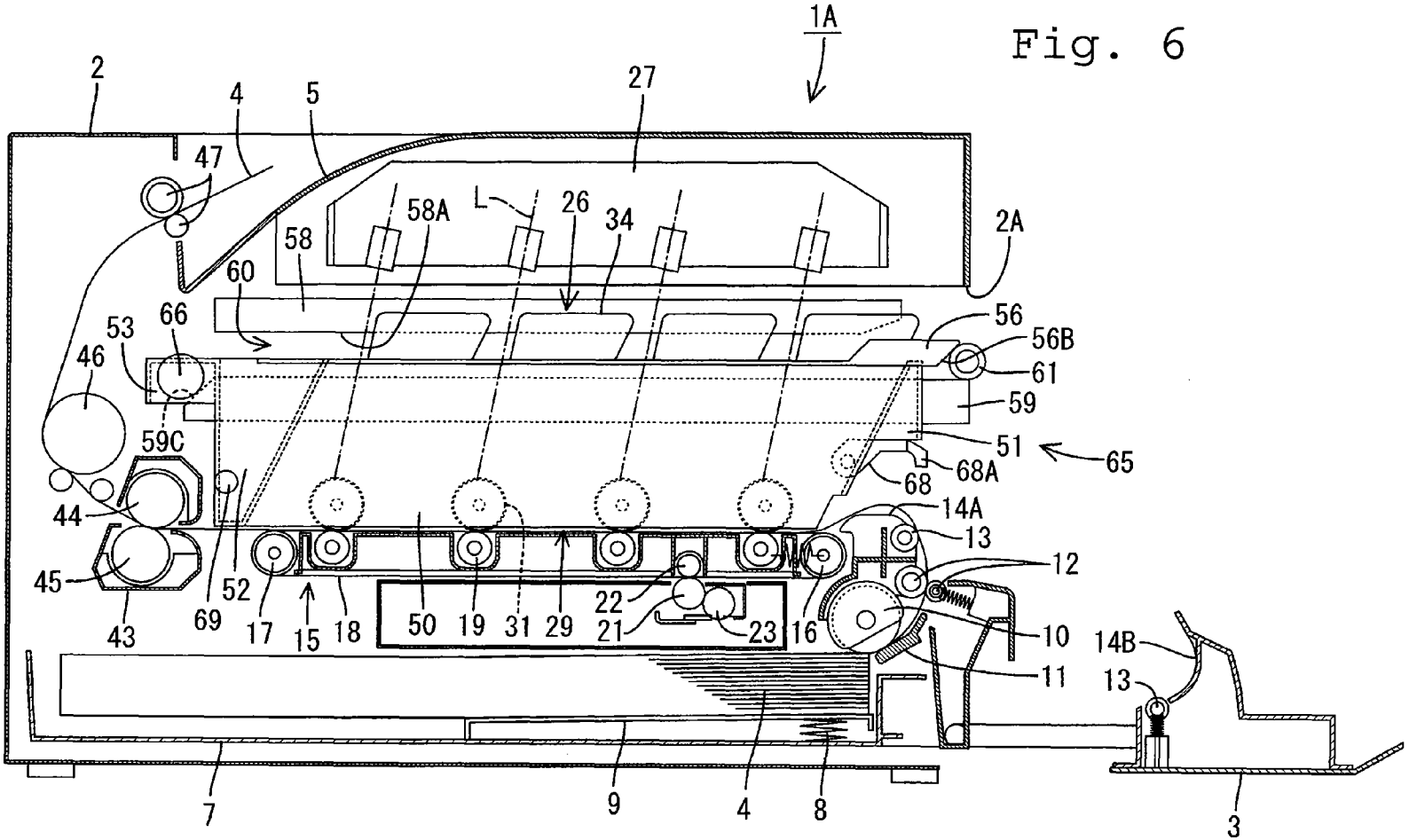
FIG. 6 is a lateral cross-section diagram showing the front surface cover open on the laser printer according to other aspects of the invention.
Figure 7:
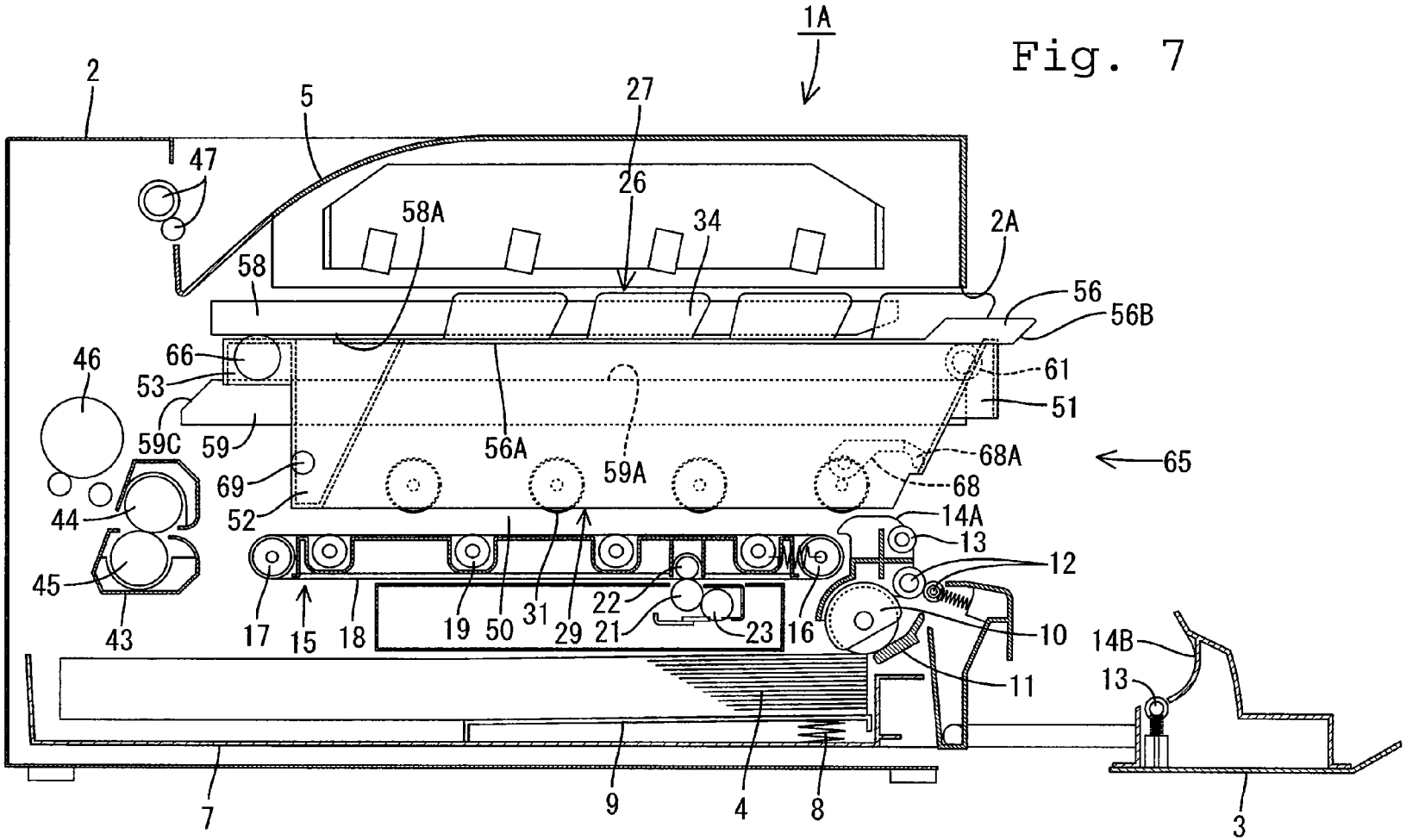
FIG. 7 is a lateral cross-section diagram showing the drawer in a partly withdrawn state.
Figure 8:
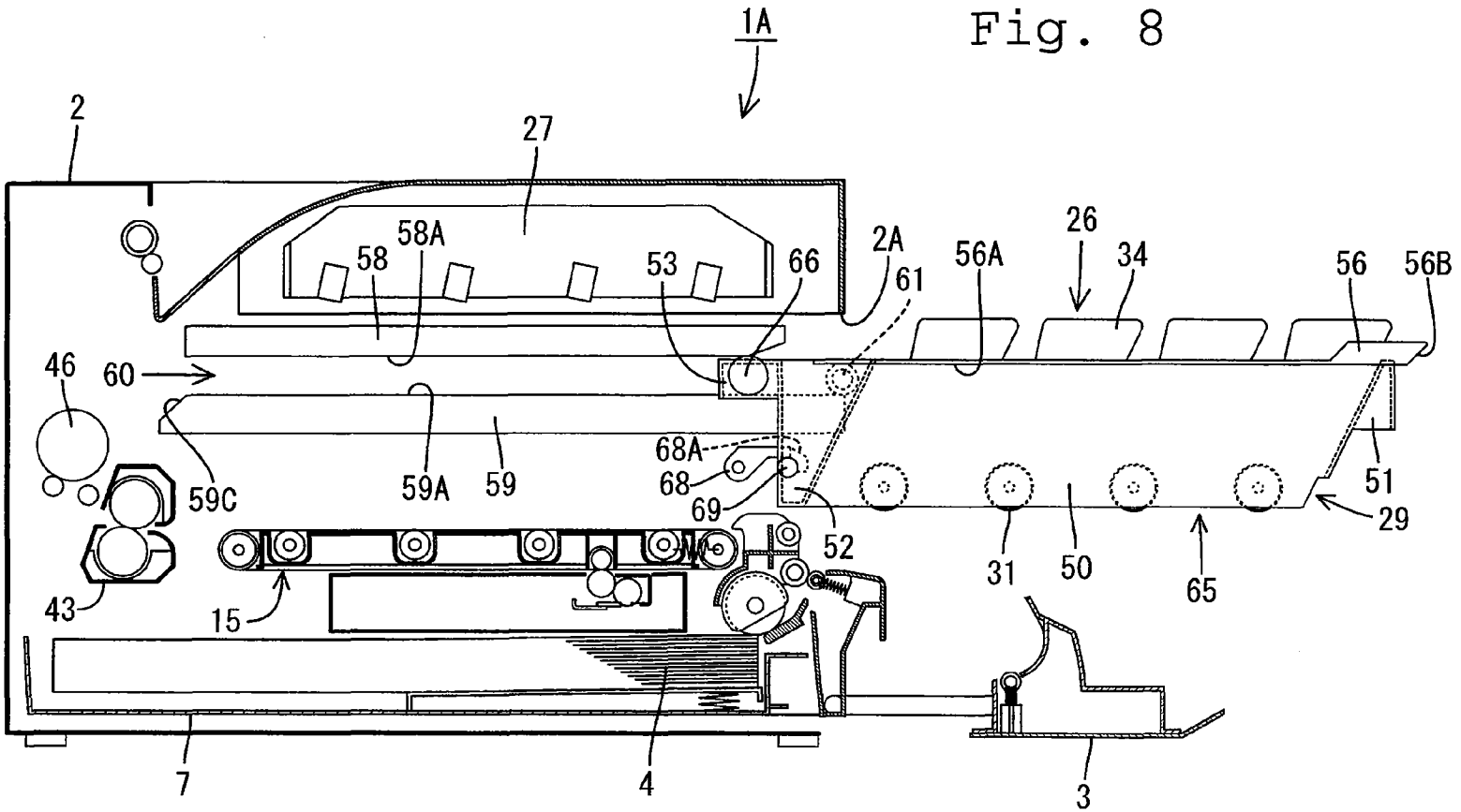
FIG. 8 is a lateral cross-section diagram showing the withdrawal motion of the drawer.
Figure 9:
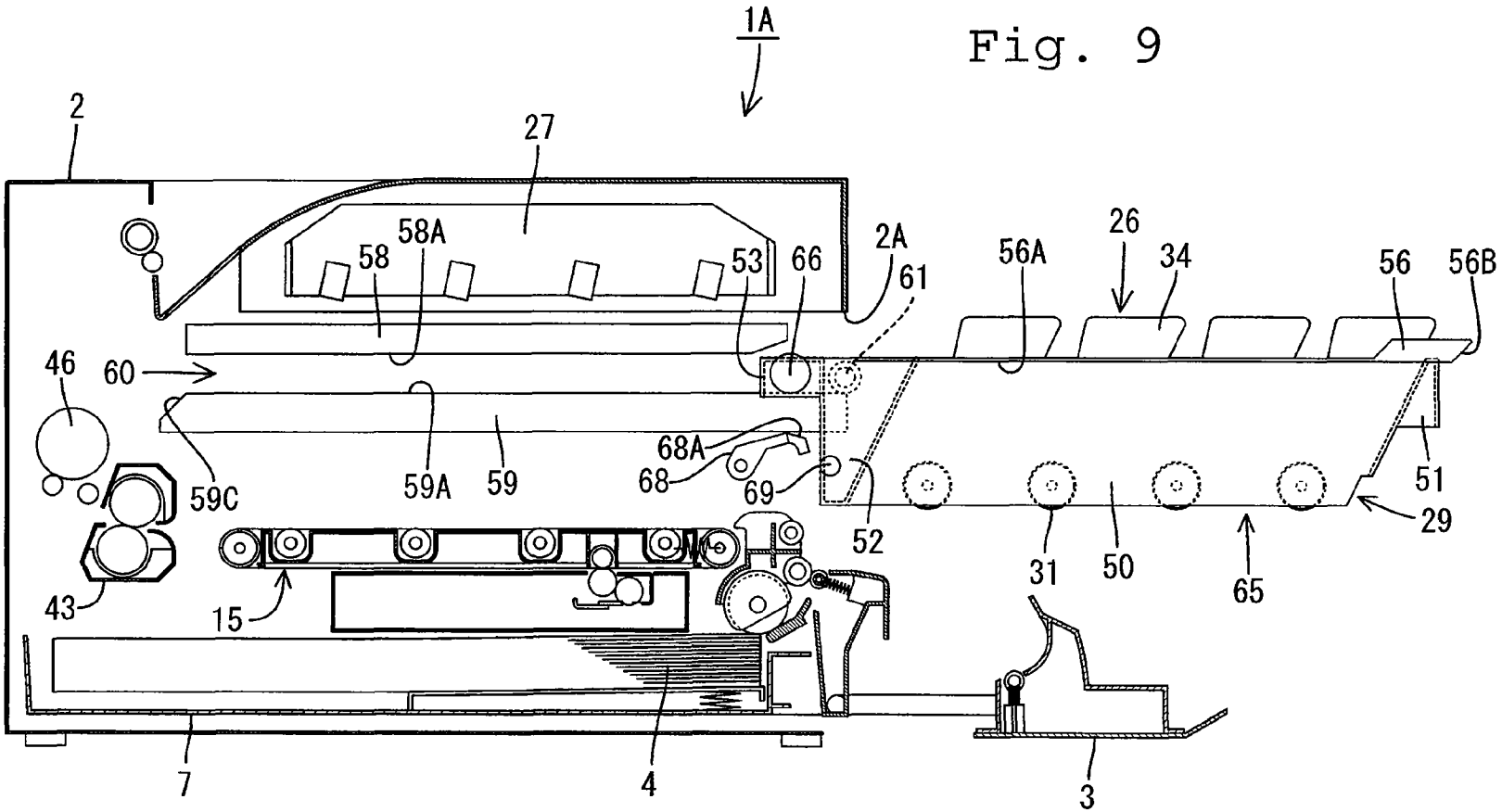
FIG. 9 is a lateral cross-section showing the drawer partly removed.

Next, we will explain additional aspects with reference to FIGS. 6 through 9. Note also that during the following explanation, the configuration will be described to the extent that it differs from the above-described figures and aspects and the same references will be used to describe elements that are similar to those above and description of those elements will be omitted. FIG. 6 is a lateral cross-section diagram that shows the front cover 3 open. FIG. 7 is a lateral cross-section diagram that shows the drawer 65 partially pulled out. FIG. 8 is a lateral cross-section diagram that shows the restricted withdrawal of the drawer 65. FIG. 9 is a lateral cross-section diagram that shows the drawer 65 partially removed.

Instead of the support portions 54 and 55 according to the above aspects, the drawer 65 that has the laser printer 1A is equipped with one support 66 that includes a rotating body that can rotate freely on both the left and right sides of the projecting portion 53. The outside diameter of the support 66 is greater than that of the stopper 61 and it has a width that is only slightly smaller than the distance between the two guiding surfaces 58A and 59A. Also, the guiding surface 59C, which has a rising front edge and guides the support 66, is formed on the rear edge of the bottom guide wall 59 in the main unit casing 2.

Furthermore, a pair of stoppers, e.g., latches 68 is located to the right and left near the lower inside of the opening 2A in the main unit casing 2. These latches 68 project inward and have hook-shaped tips 68A. On the other side, the interlocking module 69, which can engage with the tip 68A of the latch 68, protrudes on the lower left and right sides of the extending portion 52 in the drawer 65.

As shown in FIG. 6, when the drawer 65 has been properly installed in the main unit casing 2, the guiding surface 56B of the support wall 56 rests on the top of the stopper 61 and the support 66 rests on top of guiding surface 59C of the guiding wall 59, which supports the drawer 65 in a horizontal position. Additionally, when the drawer 65 is pulled forward from this state, along with the pulling motion, the front edge of the support wall 56 and the support 66 are lifted up almost simultaneously by the two guiding surfaces 56B and 59C, and the drawer 65 moves upward and forward at an angle. This causes each of the photosensitive drums 31 of the drawer 65 to separate from the conveyor belt 18.

Next, as shown in FIG. 7, as the horizontal surface 56A of the support wall 56 rides up on the stopper 61, the support 66 rides up on the guiding surface 59A of the guiding wall 59. In this state, the rotation moment takes effect in a counterclockwise direction around the stopper 61 in the drawer 65 and the rotation moment causes the lower guiding wall 59 to support the downward load from the support 66.

In the process where the drawer 65 is pulled out, the support 66 comes into contact with the guiding walls 58 and 59, which restrict the vertically inclined movement of the drawer 65 and the drawer 65 is guided forward while maintaining a vertical position. Also, once the center of gravity of the drawer 65 is out in front of the stopper 61, a rotation moment takes effect in a clockwise direction in the diagram around the stopper 61 in the drawer 65 and the rotation moment causes the upper guiding wall 58 to take and support the upward load from the support 66.

And, as shown in FIG. 8, when the drawer 65 is pulled out to the position where the housing 50 is nearly completely exposed to the outside of the opening 2A, the interlocking module 69 of the drawer 65 engages with the tip 68A of the latch 68 and restricts the withdrawing movement of the drawer 65.

As shown in FIG. 8, when removing the drawer 65 from the main unit casing 2, the tip 68A of the latch 68 is lifted up, releasing the interlocking module 69. As shown in FIG. 9, while pulling the drawer 65 forward, the support 66 raises up the rear edge of the drawer 65 slightly, so that it goes over the stopper 61, which releases the drawer 65 from the main unit casing 2. At this point, the support 66 and the stopper 61 are both able to rotate freely and the outside diameter of the support 66 is greater than that of the stopper 61 (the center of the support 66 is higher than the center of the stopper 61), so the support 66 can roll over the stopper 61.

Next, we will explain other aspects with reference to FIGS. 10 through 13.

Note also that during the following explanation, the configuration will be described to the extent that it differs from the above figures and aspects and the same references for those elements that are similar to the elements described and omit any description of them.

Figure 10:
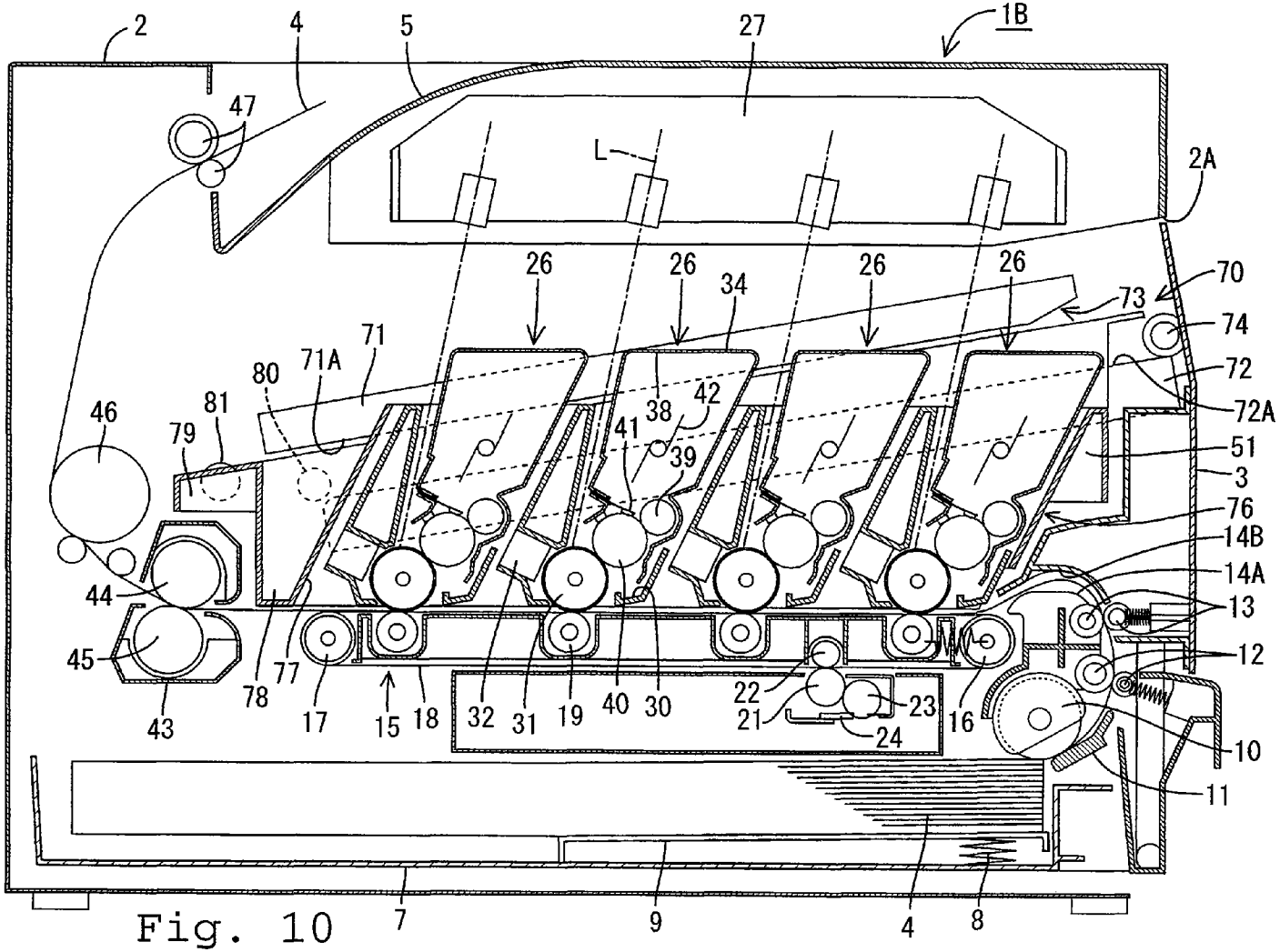
FIG. 10 is a lateral cross-section showing a schematic configuration of the laser printer according to additional aspects of the invention.
Figure 11:
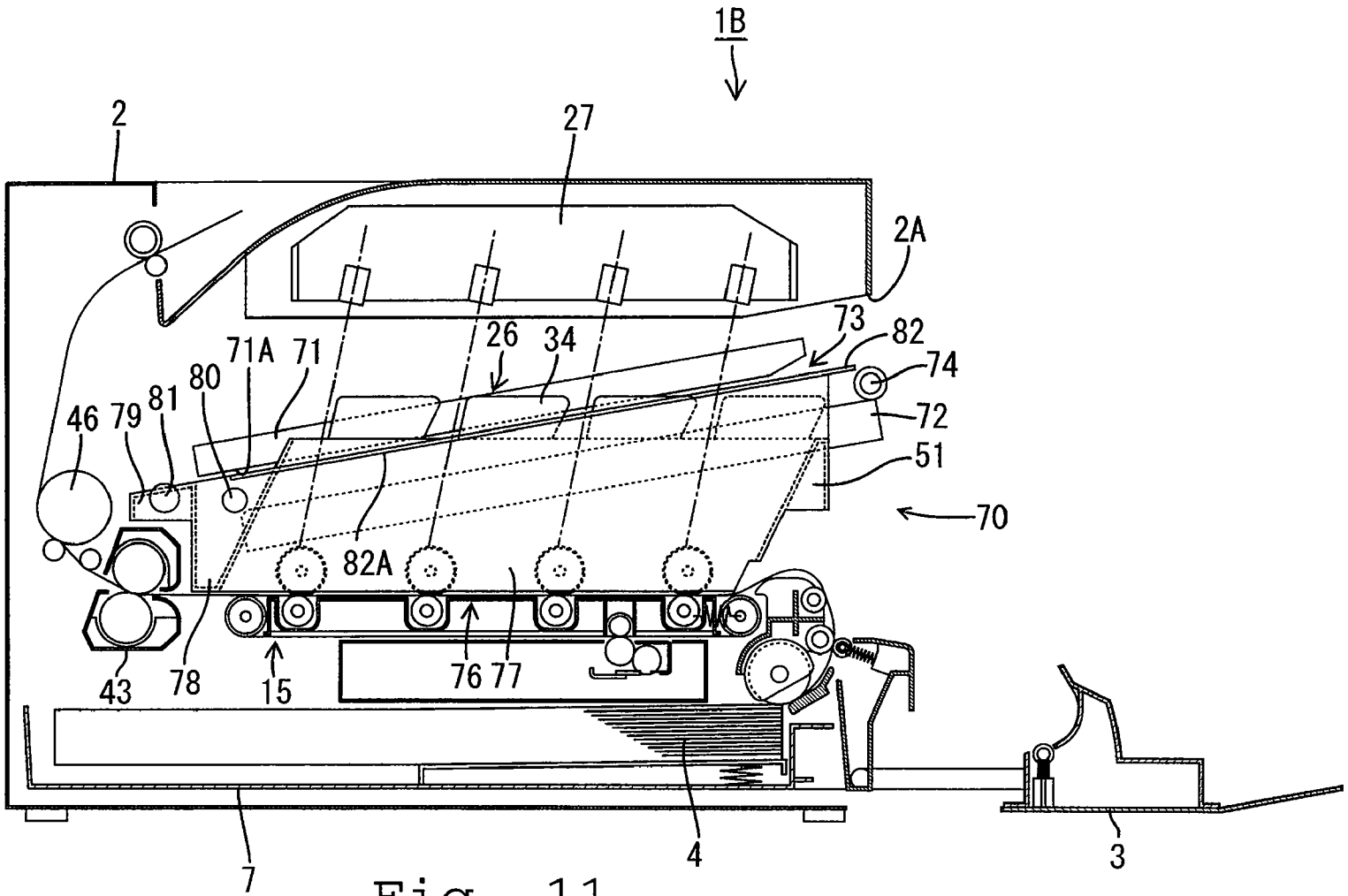
FIG. 11 is a lateral cross-section diagram showing the front surface cover open.
Figure 12:
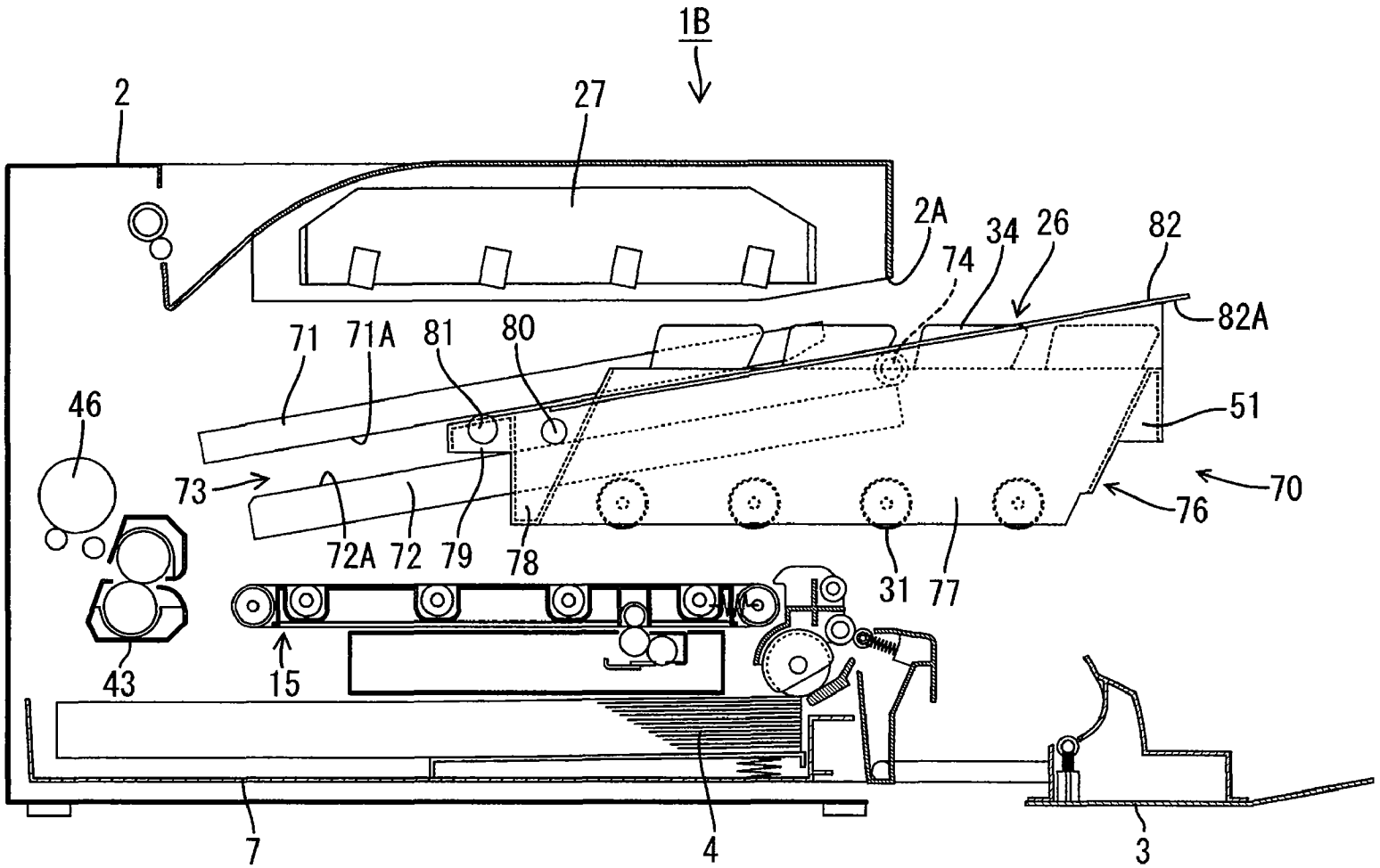
FIG. 12 is a lateral cross-section showing the drawer partly removed.
Figure 13:
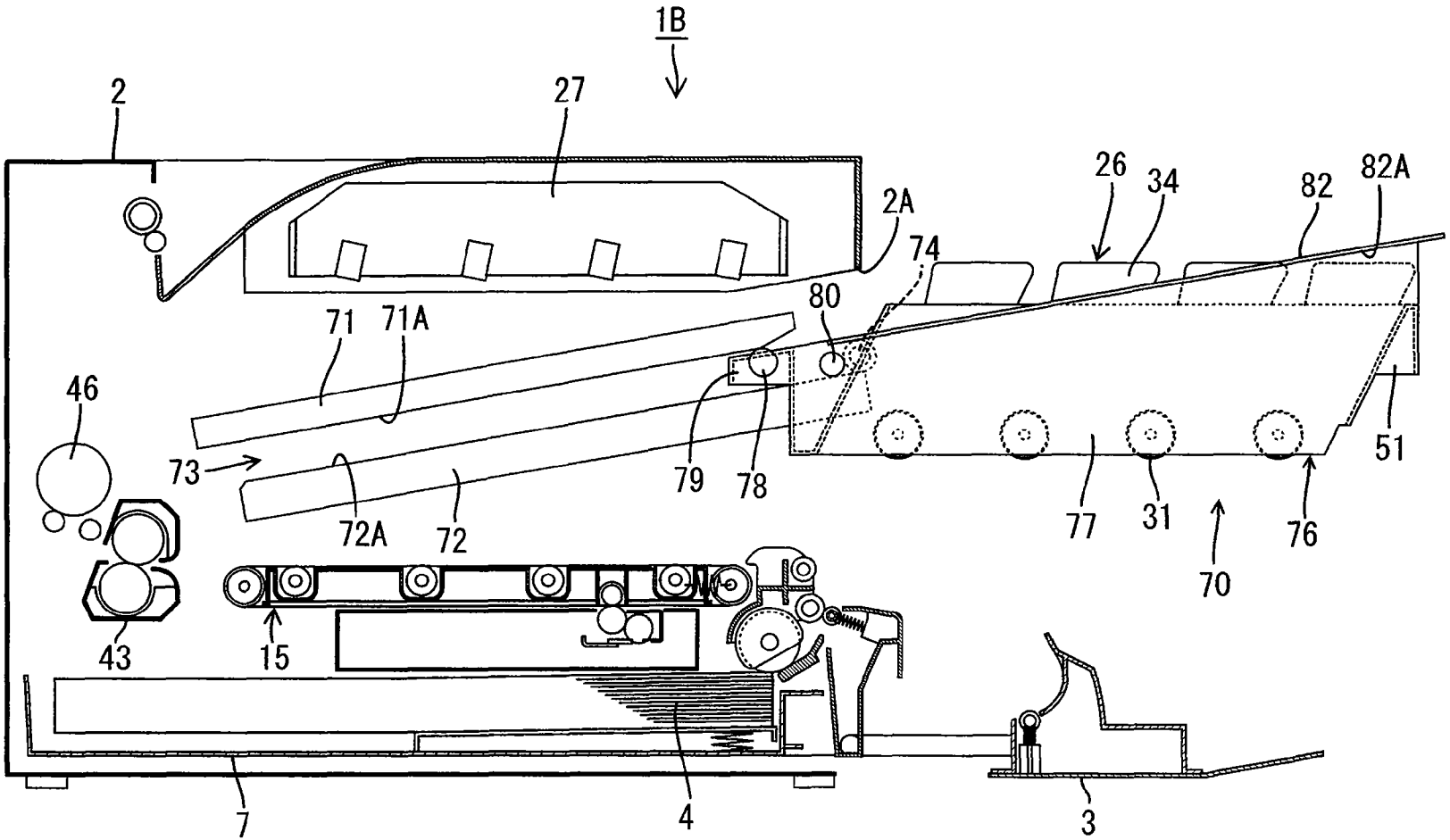
FIG. 13 is a lateral cross-section showing the withdrawal motion of the drawer.

FIG. 10 is a lateral cross-section diagram that shows a schematic configuration of the laser printer 1B. FIG. 11 is a lateral cross-section diagram that shows the front cover 3 open. FIG. 12 is a lateral cross-section diagram that shows the drawer 70 partially pulled out. FIG. 13 is a lateral cross-section diagram that shows the restricted withdrawing movement of the drawer 70.

The laser printer 1B is equipped with a vertical pair of guiding walls 71 and 72, which are inclined toward the front edge and which extend front-to-back (horizontally) on the right and left sides of the drawer 70 in the main unit casing 2. In other words, according to this aspect the withdrawal direction of the drawer 70 is inclined at an angle with respect to the upper surface of the conveyor belt 18. The upper guiding wall 71 has a guiding surface 71A that faces downward and the lower guiding wall 72 has a guiding surface 72A that faces upward. The two guiding surfaces 71A and 72A are parallel and opposed to each other and separated by a specific amount of space. Additionally, there is a groove 73 between the two guiding walls 71 and 72 (the two guiding surfaces 71A and 72A). Furthermore, the front edge (at the front edge of the groove 73) of the lower guiding surface 71A has a stopper 74 that is made of a rotating body that can rotate freely.

Elsewhere, as in the drawer 25 described with reference to FIGS. 1-5, the drawer 70 is equipped with a housing 77 that houses four image-forming portions 26 and an extending portion 78 that extends in a rearward direction and a projecting portion 79 that projects partially rearward from the rear upper corner of the extending portion 78 (behind the direction of the extension). Inside the main unit casing 2, the fixing unit 43 is located behind the housing 77 (behind the extending portion 78) and at right angles to the projecting portion 79 so that it overlaps the direction of withdrawal (along the direction of the guiding walls 71 and 72).

Additionally, in the drawer 25 in FIGS. 1-5, a first support 80 made from a freely rotating body is attached to the left and right lateral surfaces of the extending portion 78 and a second support 81, made of a freely rotating body, is attached to the right and left lateral surfaces of the projecting portion 79. Furthermore, on the upper edge of the right and left lateral surfaces of the housing 77, in front of the first support 80 and extending along the direction of withdrawal (in other words, along the direction of the guiding walls 71 and 72), is a plate-like, support wall 82. The support wall 82 has a downward-facing linear surface 82A, which extends front-to-back. Also, the support wall 82 is arranged to avoid contact with the vertical guiding surfaces 71A or 72A in the groove 73.

As shown in FIGS. 10 and 11, when the drawer 70 is properly installed inside the main unit casing 2, the first support 80 is positioned at the rear edge of the lower guiding surface 72A and the second support 81 is not in the groove 73. If the drawer 70 is pulled forward in this state, the first support 80 will be guided upward along the guiding surface 72A, which will cause the drawer 70 to move diagonally upward and each of the photosensitive drums 31 will separate from the conveyor belt 18.

Next, as shown in FIG. 12, if the drawer 70 is pulled out even further, the second support 81 goes into the groove 73 and the two support portions 80 and 81 come into contact with the guiding surfaces 71A and 72A of the guiding walls 71 and 72, which restrict the vertically inclined movement of the drawer 70. Note also that in the state in FIG. 12, a rotation moment in the counterclockwise direction takes effect around the stopper 74 in the drawer 70 and the lower guiding wall 72 supports the downward load from the first support 80. Once the center of gravity of the drawer 70 is in front of the stopper 74, a rotation moment in a clockwise direction will take effect around the stopper 74 in the drawer 70 and the upper guiding wall 71 will support the upward load from the second support 81 due to the rotation moment.

Then, as shown in FIG. 13, when the drawer 70 is pulled out to the position where the housing 77 is nearly completely exposed outside the opening 2A, the first support 80 engages with the stopper 74 and the withdrawing movement of the drawer 70 is restricted.

If the drawer 70 is pulled out of the main unit casing 2 from the state shown in FIG. 13, the front edge of the drawer 70 will be lifted up and, after releasing the first support 80 and the stopper 74, it will be possible to remove the drawer 70 from the main unit casing 2 by pulling forward on the drawer 70.

Next, other aspects will be described with reference to FIGS. 14 through 19.

Note also that during the following explanation, the configuration will be described to the extent that it differs from FIGS. 1-5 and the same references will be used for elements that are similar to those previously described and description of them will be omitted.

Figure 14:
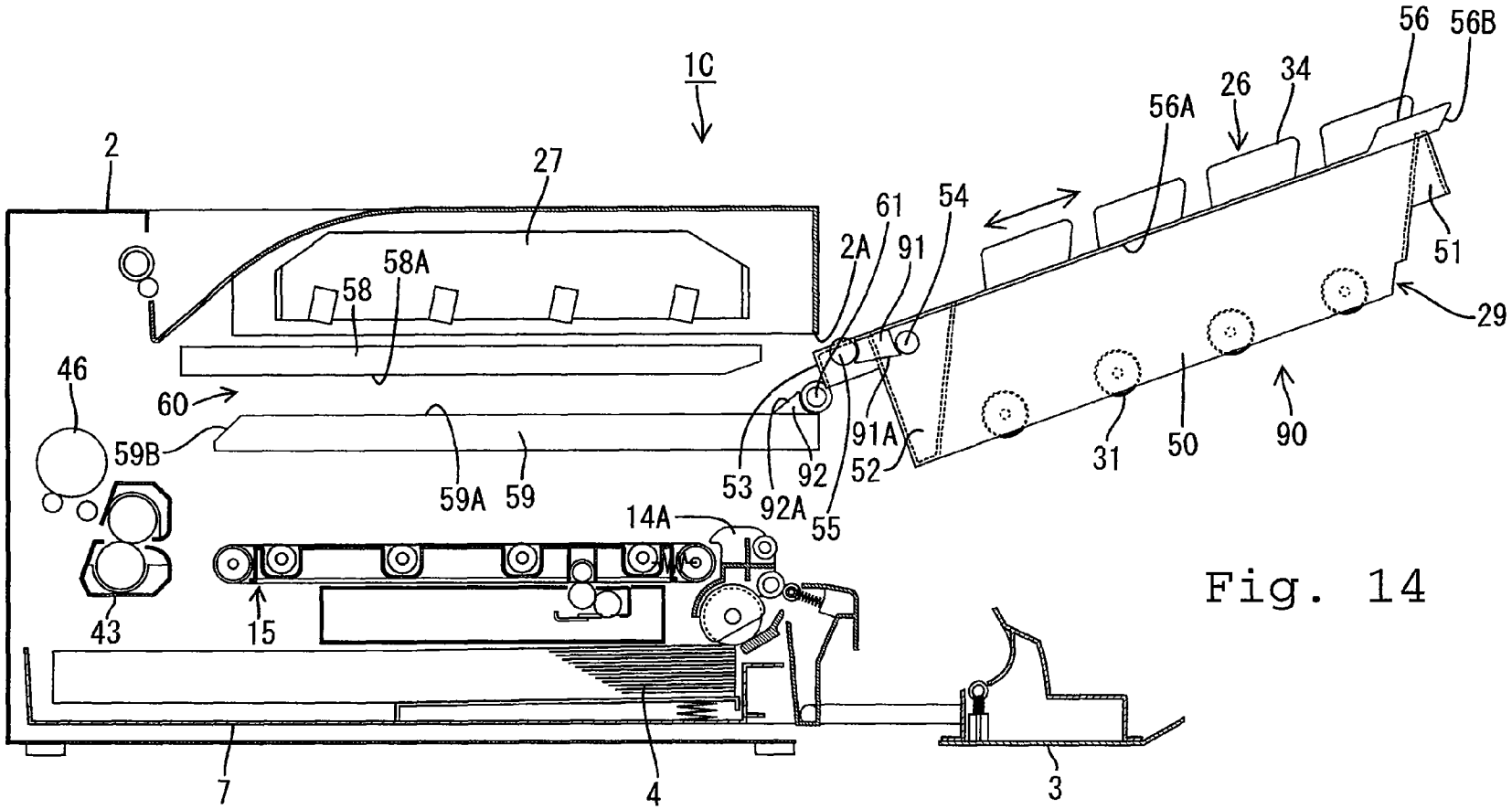
FIG. 14 is a lateral cross-section diagram showing the drawer removed from the main unit casing in the laser printer according to aspects of the invention.
Figure 15:
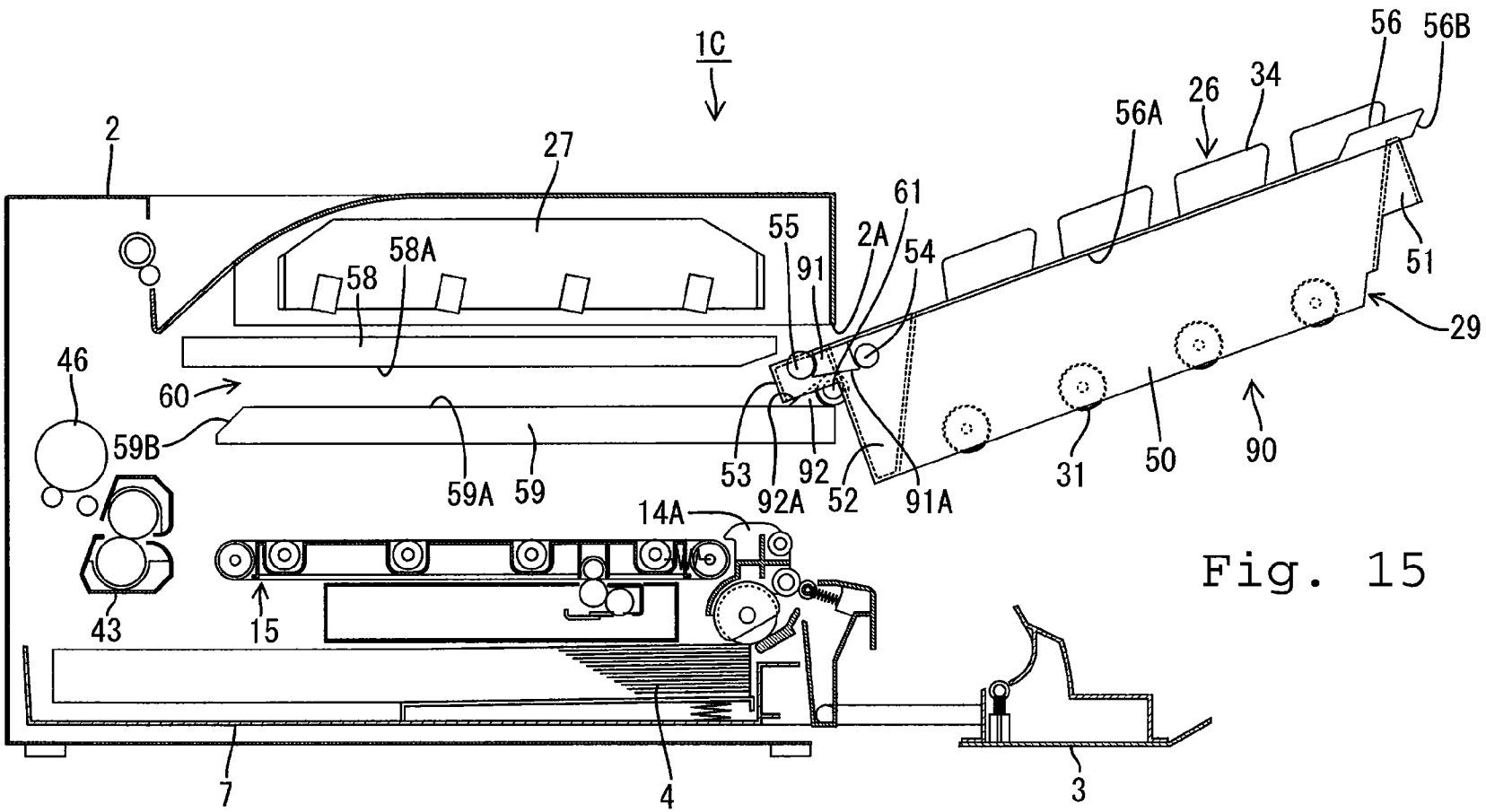
FIG. 15 is a lateral cross-section showing the support portion in contact with a stopper.
Figure 16:
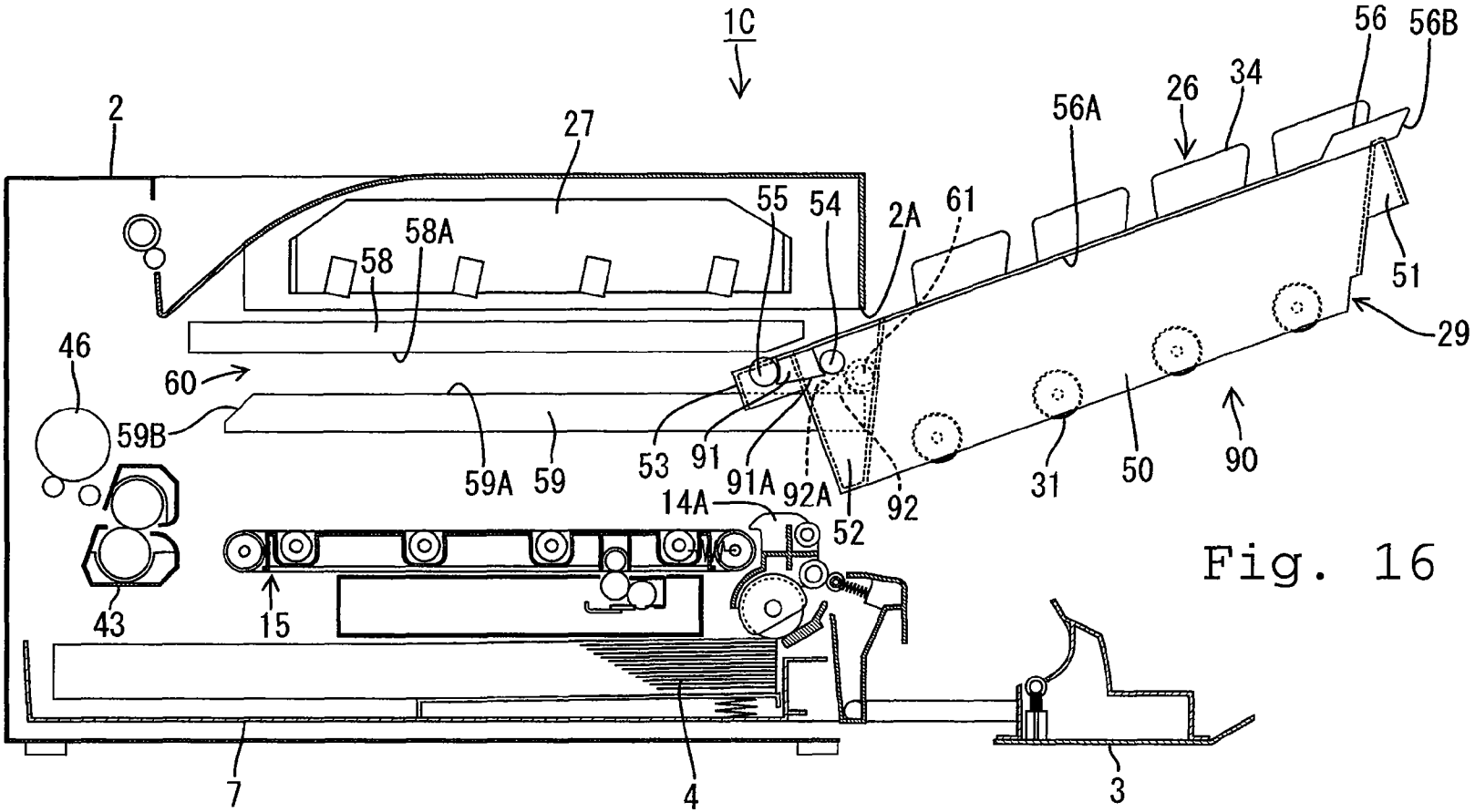
FIG. 16 is a lateral cross-section showing a guide guiding a first support.
Figure 17:
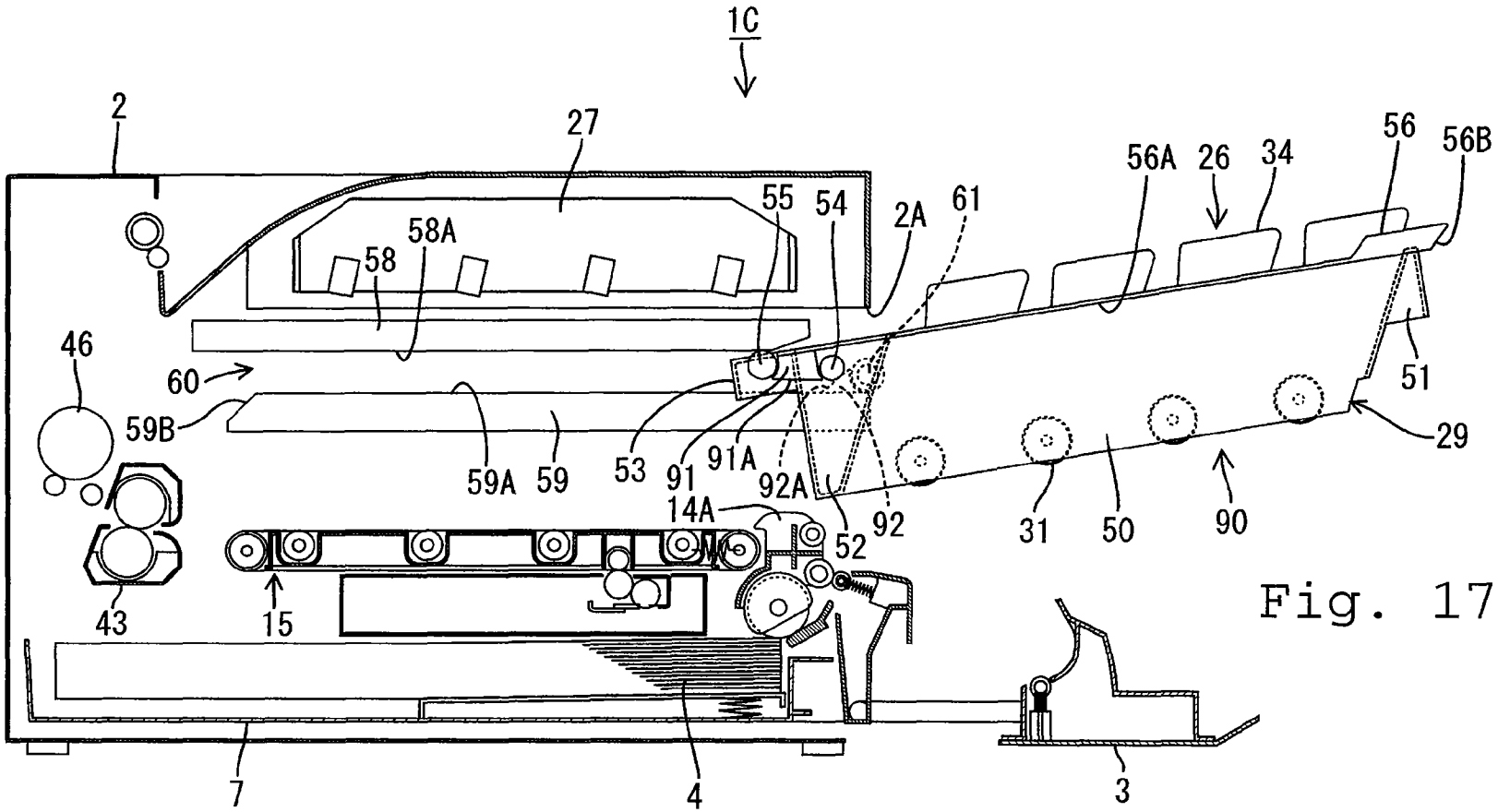
FIG. 17 is a lateral cross-section showing the guide guiding the first support.
Figure 18:
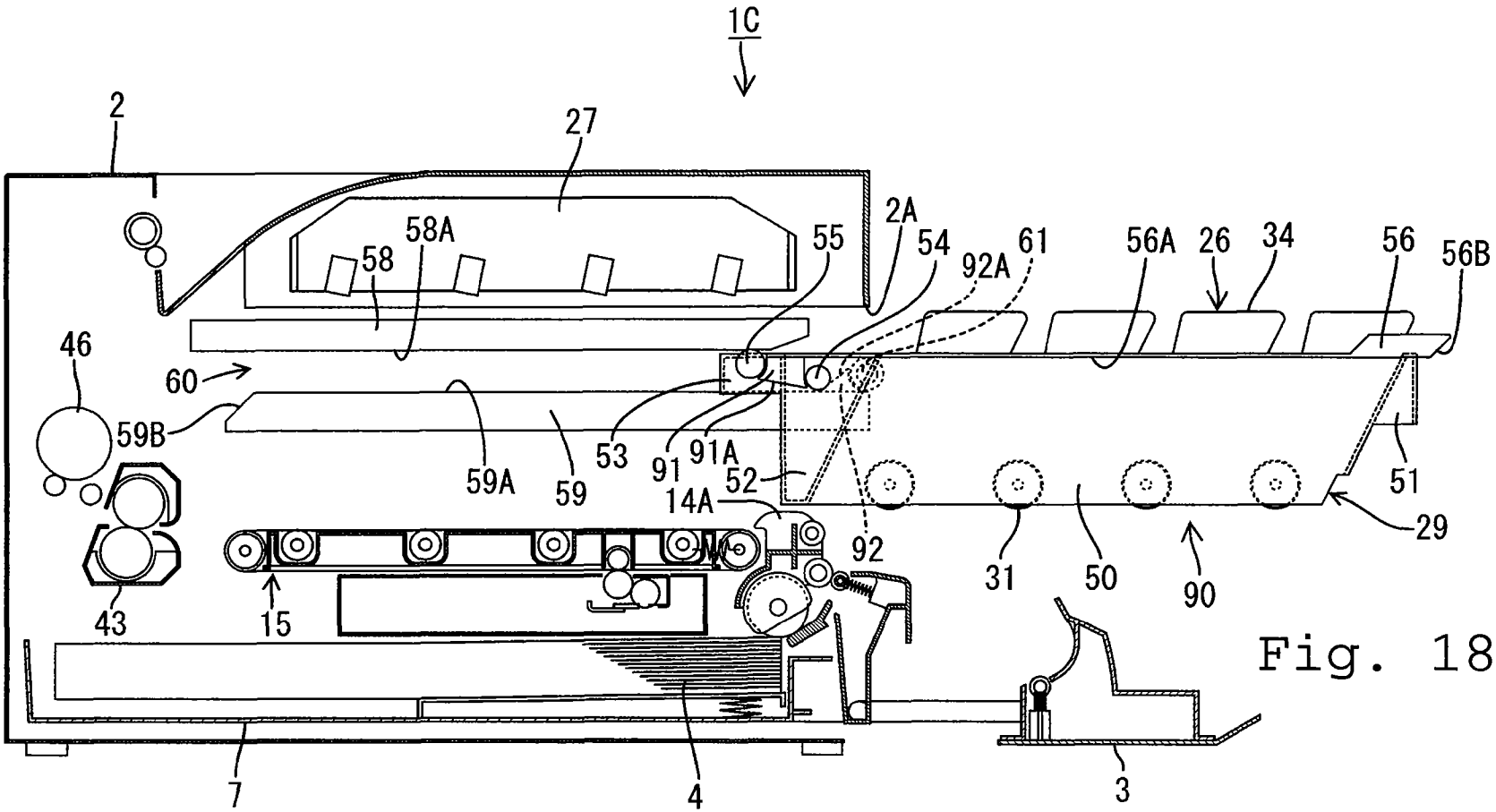
FIG. 18 is a lateral cross-section showing the guide guiding the first support.
Figure 19:
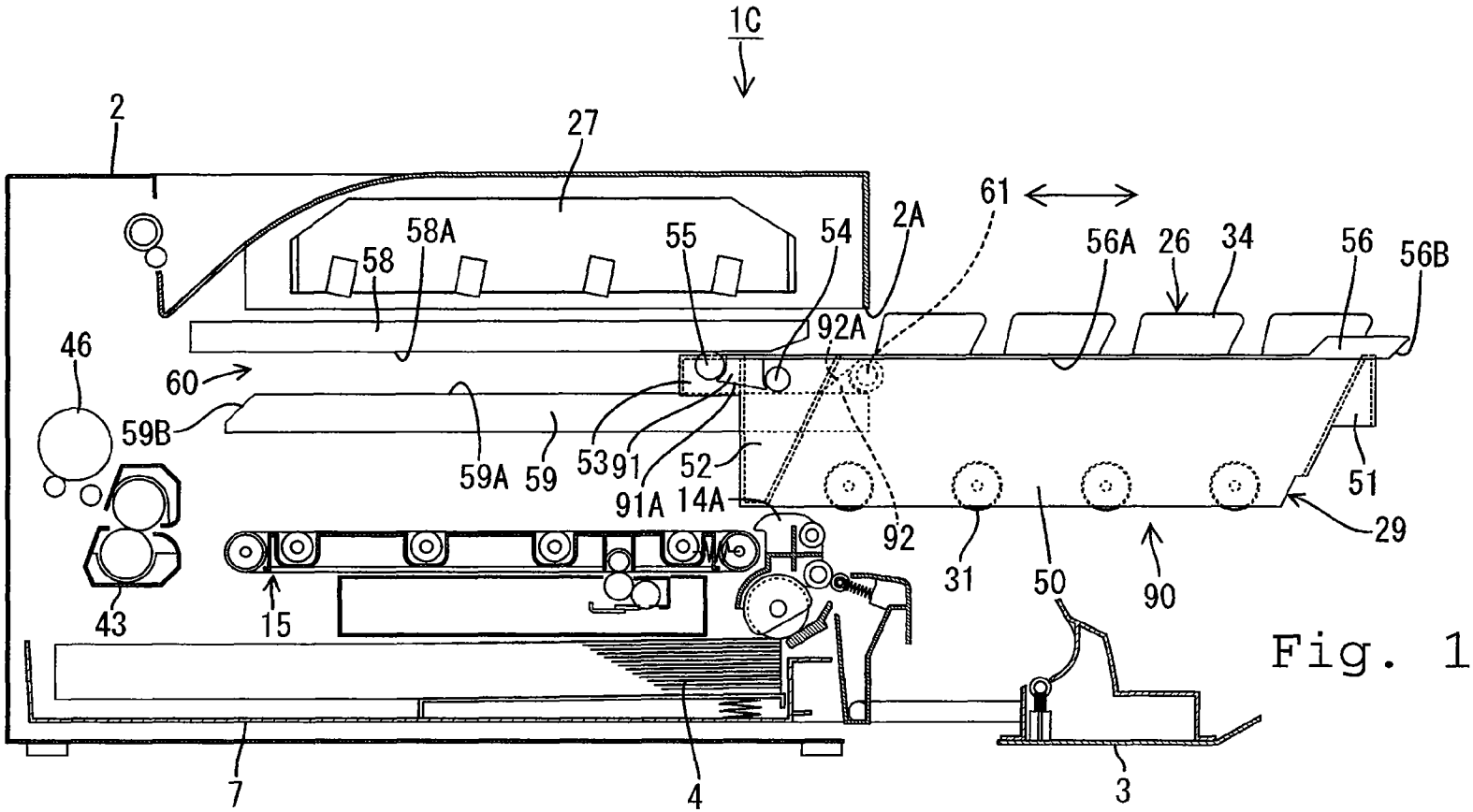
FIG. 19 is a lateral cross-section showing the position of the drawer partly withdrawn.

FIG. 14 is a lateral cross-section diagram that shows the drawer 90 removed from the main unit casing 2. FIG. 15 is a lateral cross-section diagram that shows the stopper 61 in contact with a guide portion 91. FIGS. 16 through 18 are lateral cross-section diagrams that show the process of the first support 54 being guided by the guide 92. FIG. 19 is a lateral cross-section diagram that shows the state of the drawer 90 partially removed.

A synthetic resin guide portion 91 is located on both the right and left lateral surfaces of the drawer 90 in the laser printer 1C. The synthetic resin guide portion 91 fills in the space between the first support 54 and the second support 55. When the drawer 90 is placed in a horizontal position (see FIG. 19), the bottom surface of the guide portion 91 becomes the guiding surface 91A, which is inclined so that the front edge will go down. The guiding surface 91A is basically formed along the common contact line between the two portions 54 and 55.

Also, on the main unit casing 2 at the front edge (the front edge of the groove 60) of the guiding surface 59A of the lower guiding wall 59 is the stopper 61 described above and behind it, the guide or stopper 92. The guide 92 is made of plastic and is equipped with an inclined surface 92A that is tilted on the front end. The rear end side of the inclined surface 92A is aligned with the guiding surface 59A and is constituted so that its front end is aligned with the upper surface of the stopper 61.

To install the drawer 90 in the main unit casing 2 after it has been removed, first, as shown in FIG. 14, the front edge of the drawer 90 is raised up and angled downward and rearward, while maintaining the inclined position, inserting the rear edge of the drawer 90 into the opening 2A of the main unit casing 2 and inserting each of the left and right support portions 54 and 55 into the groove 60 between the guiding walls 58 and 59. Then, when the second support 55 passes the top of the stopper 61, it comes into contact with the guiding surface 91A of the guide portion 91 as shown in FIG. 15 and the rear edge of the drawer 90 is supported by the stopper 61. At this point, the guide portion 91 causes the stopper 61 and the guide or stopper 92 to go between the two support portions 54 and 55, keeping them from catching. If the drawer 90 is pushed rearward from this state, the guide portion 91 will slide back along the stopper 61, guided by the guiding surface 91A of the guide portion 91 and, as shown in FIG. 16, the first support 54 will go over the stopper 61, making contact with the inclined surface 92A of the guide or stopper 92.

Next, when the front edge of the drawer 90 is lowered (when the hand holding the front edge of the drawer 90 is relaxed), the first support 54 slides rearward over the inclined surface 92A and the drawer 90 rotates clockwise with the first support 54 at the center and, as shown in FIG. 17, the second support 55 comes into contact with the guiding surface 58A of the upper guiding wall 58. Then, as shown in FIG. 18, when the first support 54 comes into contact with the guiding surface 59A of the guiding wall 59, the rotation of the drawer 90 stops and the drawer 90 is supported in a horizontal position. In this way, the inclined surface 92A guides the drawer 90 downward and rearward (to the interior) and the second support 55 goes accurately deep into the groove 60. Thus, the drawer 90 can be kept from falling out because the entry of the drawer 65 was shallow and the second support 55 slipped out the front from the front edge of the guiding wall 58. When the drawer 90 is pushed rearward (see FIG. 19) from the state in FIG. 18, the installation of the drawer 90 will be complete when the drawer 90 reaches the proper installation position (not shown).

Next, as shown in FIG. 19, when pulling out the drawer 90 after it has been installed in the main unit casing 2, the drawer 90 is guided by the vertical guiding surfaces 58A and 59A and is drawn horizontally forward. Next, when the first support 54 reaches the front edge of the guiding wall 59, the first support 54 contacts and engages the stopper 92, so the pulling out motion of the drawer 90 is restricted.

Next, to remove the drawer 90 from the main unit casing 2, the front edge of the drawer 90 is lifted upward at an angle. Then, the first support 54 moves upward and forward at an angle along the inclined surface 92A of the guide or stopper 92 and the drawer 90 turns in a counterclockwise direction, moving into an inclined position with the front edge raised (see FIGS. 16 and 17). If the front edge of the drawer 90 is raised even further from this state, then, as shown in FIG. 15, the first support 54 goes beyond the stopper 61 and the guiding surface 91A of the guide portion 91 rides up on top of the stopper 61. At that point, by holding the rear edge of the drawer 90 and moving the drawer 90 upward at an angle, the drawer 90 can be removed from the main unit casing 2 as shown in FIG. 14.

The above aspect makes it possible to remove the drawer 90 easily from the main unit of the device by moving it upward in the direction of withdrawal from a withdrawn position. Additionally, if the direction of withdrawal and the direction of removal are the same for the drawer 90, there is a risk that the drawer 90 will be pulled all the way out during withdrawal, but with this configuration, the direction of withdrawal and the direction of removal of the drawer 90 are different, which prevents the drawer 90 from being removed accidentally.

Also, when installing the drawer 90 in the main unit casing 2, the first support 54 is guided along the inclined surface 92A of the guide 92, so the drawer 90 (first support 54) drops down and is pushed into the interior. Because the first support 54 supports the drawer 90 in a stable manner and keeps it from tipping over, the drawer 90 can be installed smoothly.

Additionally, by rotating the drawer 90 so that its front edge rises, the engagement of the first support 54 and the stopper 92 and the stopper 61 can be released, so the drawer 90 can be easily removed from the main unit casing 2.

Furthermore, because there is a guide portion 91 that restricts the entry of the guide or stopper 92 and the stopper 61 in between the support portions 54 and 55, the guide or stopper 92 and stopper 61 can be prevented from getting caught in between the pair of support portions 54 and 55 when the drawer 90 is installed or removed, which allows for smoother operation.

Operation can also be made smoother when installing or removing the drawer 90 because the stopper 61 is guided by the guiding surface 91A, which is located on the guide portion 91.

This invention is not limited to the aspects described above. Other aspects would also be contained within the scope the invention and, moreover, it would also be possible to implement various other aspects not described that are within the scope of the invention without departing from the invention.

(1) In each of the aspects described above, examples were disclosed in which laser printer were used where the image was transferred from the image carrier (photosensitive drum) to the recording medium (paper). However, one skilled in the art will appreciate that these aspects could also be used in color laser printers, which transfer the image to the recording medium using an intermediate transfer device (intermediate transfer belt or intermediate transfer drum).

(2) In each of the aspects described above, printers are described in which four colors of toner, yellow, magenta, cyan and black, were used, although aspects could be used in applications having two colors of toner, such as red and black or six colors of toner, etc.

(3) In each of the aspects described above, printers are described in which just the developing cartridges in the image-forming portions can be inserted into or removed from the housing of the drawer. However, it would also be possible to insert or remove other component elements (photosensitive drum, charger, etc.) of the image-forming portions from the housing.

(4) In each of the aspects described above, the guiding walls are formed on the left and right sides, in upper and lower pairs with their guiding surfaces opposing each other. However, it would also be possible to have a configuration with just a guiding wall on the right and left sides, for example, and to use the upper and lower surfaces of the guiding walls as guiding surfaces and for the pair of support portions located on the drawer side be in contact with the upper and lower guiding surfaces.

(5) In each of the aspects above, the fixing units overlap the underside of the projecting portion that projects out of the rear upper surface of the drawer (pullout module). One skilled in the art will appreciate however that it would also be possible, for example, to arrange the fixing units so that they overlap the upper side of the projecting portion or to have the fixing units overlapped between projecting portion that projects to both the right and left sides.

(6) In some aspects described above, the drawer is configured so that when pulled out, the front edges and rear edges of the drawer are simultaneously raised, thereby separating from the conveyor belt. It will appreciated that the drawer could be configured so that the front edge and rear edge of the drawer rises at different times, in which case, the amount of force required to raise the drawer could be made lower than when both ends are raised simultaneously.

What is claimed is:

1. An image forming device comprising:

a main unit casing having an opening;

a drawer configured to be movable in a first direction from an inner position in which the drawer is located at an inner side of the main unit casing to an outer position in which the drawer is located at an outer side of the main unit casing, the drawer including a plurality of photosensitive drums arranged in a line in the first direction and a support disposed closer to a rear edge of the drawer than to a front edge of the drawer, the rear edge of the drawer being an edge of the drawer furthest from the opening when the drawer is at the inner position, the front edge of the drawer being an edge of the drawer closest to the opening when the drawer is at the inner position; and a guide provided in the main unit casing and configured to guide the drawer, the guide having a main guiding surface and an upward-facing guiding surface for guiding the support, the upward-facing guiding surface positioned between the main guide surface and a rear edge of the guide, which is a portion of the guide furthest from the opening when the drawer is at the inner position, inclined relative to the main guiding surface, directed upward toward the main guiding surface in the first direction, being the portion of the guide furthest from the opening that is configured to make contact with the support when the drawer is at the inner position, and terminating at the main guiding surface.

2. An image forming device according to claim 1, wherein the main unit casing has a stopper disposed closer to the front edge of the drawer than to the rear edge of the drawer when the drawer is at the inner position, wherein the drawer has a downward-facing guiding surface disposed closer to the front edge of the drawer than to the rear edge of the drawer and configured to contact the stopper.

3. An image forming device according to claim 1, wherein the guide has an inclined surface for guiding the support, the inclined surface originating from the main guiding surface and being inclined relative to the main guiding surface in the first direction and being directed upward, wherein the inclined surface is disposed closer to the front edge of the drawer than the rear edge of the drawer when the drawer is at the inner position.

4. An image forming device according to claim 1, wherein the first direction is a substantially horizontal direction.

5. An image forming device comprising:

a main unit casing having an opening;

a drawer configured to be movable in a first direction from an inner position in which the drawer is located at an inner side of the main unit casing to an outer position in which the drawer is located at an outer side of the main unit casing, the drawer including a plurality of photosensitive drums arranged in a line in the first direction and a support disposed closer to a rear edge of the drawer than to a front edge of the drawer, the rear edge of the drawer being an edge of the drawer furthest from the opening when the drawer is at the inner position, the front edge of the drawer being an edge of the drawer closest to the opening when the drawer is at the inner position; and a guide provided in the main unit casing and configured to guide the drawer, the guide having a main guiding surface and an inclined surface for guiding the support, the inclined surface originating from the main guiding surface and being inclined relative to the main guiding surface in the first direction and directed upward, wherein the inclined surface is disposed closer to the front edge of the drawer than the rear edge of the drawer when the drawer is at the inner position.

6. An image forming device according to claim 5, wherein the first direction is substantially a horizontal direction.

7. An image forming device comprising:

a main unit casing having an opening and a stopper; and a drawer configured to be movable in a first direction from an inner position in which the drawer is located at an inner side of the main unit casing to an outer position in which the drawer is located at an outer side of the main unit casing, the drawer including a plurality of photosensitive drums arranged in a line in the first direction and a downward-inclined guiding surface that terminates at a surface that extends in a direction opposite the first direction, the downward inclined guiding surface configured to contact the stopper and disposed closer to a front edge of the drawer than to a rear edge of the drawer, the rear edge of the drawer being an edge of the drawer furthest from the opening when the drawer is at the inner position, the front edge of the drawer being an edge of the drawer closest to the opening when the drawer is at the inner position, wherein the stopper is disposed closer to the front edge of the drawer than to the rear edge of the drawer when the drawer is at the inner position.

8. An image forming device according to claim 7, wherein the first direction is a substantially horizontal direction.

* * * * *